United States Patent [19]

Ericson et al.

[11] Patent Number: 4,938,393

[45] Date of Patent: Jul. 3, 1990

[54] BIMODAL STORAGE AND DISPENSING PACKAGE FOR FLUENT MATERIAL

[75] Inventors: Kenneth R. Ericson; Paul K. Platt; Robert H. Van Coney; Elmer K. Linman, all of Cincinnati, Ohio

[73] Assignee: The Procter & Gamble Company, Cincinnati, Ohio

[21] Appl. No.: 432,658

[22] Filed: Nov. 6, 1989

Related U.S. Application Data

[63] Continuation of Ser. No. 209,126, Jun. 2, 1988, abandoned, which is a continuation of Ser. No. 803,269, Nov. 27, 1985, abandoned.

[51] Int. Cl.[5] ..... B67D 5/40

[52] U.S. Cl. ..... 222/380; 222/383; 222/387; 222/494; 222/525; 222/532; 222/537

[58] Field of Search ..... 222/522, 526, 526, 531, 222/532, 537, 380, 383, 384, 385, 490–494, 256, 387, 391, 476

[56] References Cited

U.S. PATENT DOCUMENTS

| | | | |
|---|---|---|---|
| 203,672 | 5/1878 | Swain | 222/525 |
| 1,362,333 | 12/1964 | Davisdon | 222/207 |
| 1,620,892 | 3/1927 | Janer | 222/525 |
| 2,071,657 | 2/1937 | Richardson | 221/60 |

(List continued on next page.)

FOREIGN PATENT DOCUMENTS

| | | | |
|---|---|---|---|
| 132189 | 1/1985 | European Pat. Off. | 222/531 |
| 3400373 | 11/1985 | Fed. Rep. of Germany . | |

OTHER PUBLICATIONS

Commonly Assigned Co-Pending U.S. patent application Ser. No. 759,390 filed 8/6/85 in the name of James Lee Drobish.

Commonly Assigned Co-Pending U.S. patent application Ser. No. 781,152 filed on Sep. 26, 1985 in the name of James Lee Drobish.

Commonly Assigned Co-Pending U.S. patent application Ser. No. 789,871 filed on Oct. 21, 1985 in the name of Arnold G. Benecke, Douglas H. Benson, William H. Goodman, Jr., and Robert H. Van Coney.

*Primary Examiner*—Kevin P. Shaver

*Attorney, Agent, or Firm*—E. Kelly Linman; John V. Gorman; Richard C. Witte

[57] ABSTRACT

A storage and dispensing package for fluent material capable of bimodal operation. The package has a first mode of operation capable of storing the fluent material without leakage when the package is subjected to unintentional external forces. The package is also provided with a second mode of operation capable of dispensing the fluent material when the package is subjected to external forces intentionally applied by the user. The second mode of operation is also capable of automatically isolating substantially all of the fluent material remaining in the package from the surrounding atmosphere as soon as the intentionally applied external forces are removed. In a preferred embodiment, the package comprises a container, means for applying pressure to the fluent material in the container, a fluid conduit having an inlet end for receiving the fluent material from the container and a discharge end remote from the inlet end. A first valve which does not open in response to pressure is provided at the inlet end of the conduit. In its "closed" position, the valve prevents fluid communication between the fluent material in the container and the inlet end of the fluid conduit. In its "open" position, the valve permits fluid communication between the fluent material in the container and the inlet end of the fluid conduit. The valve further includes means for switching the valve between its "closed" and "open" positions. A second normally closed valve is also provided at the discharge end of the fluid conduit. The second valve prevents fluid communicaton between fluent material contained in the fluid conduit and the surrounding atmosphere. The second valve is openable only in response to pressure applied by the fluent material in the fluid conduit, and is automatically closable whenever the pressure on the fluent material in the conduit is relieved.

2 Claims, 22 Drawing Sheets

U.S. PATENT DOCUMENTS

| | | | |
|---|---|---|---|
| 2,880,914 | 4/1959 | Lerner et al. | 222/321 |
| 2,971,680 | 2/1961 | Wilson et al. | 222/537 X |
| 3,007,614 | 11/1961 | Morrow | 222/490 |
| 3,012,698 | 12/1961 | Wiederquist et al. | 222/490 X |
| 3,116,856 | 1/1964 | Prussin et al. | 222/536 X |
| 3,146,913 | 9/1964 | Nagai | 222/532 X |
| 3,241,726 | 3/1966 | Chester | 222/490 X |
| 3,371,827 | 3/1968 | Micallef | 222/536 X |
| 3,506,163 | 4/1970 | Rauh et al. | 222/212 |
| 3,568,895 | 3/1971 | Porter | 222/534 |
| 3,618,829 | 11/1971 | Elmore et al. | 222/531 X |
| 3,653,546 | 4/1972 | Hazard | 222/83 |
| 3,655,099 | 4/1972 | Hazard | 222/153 |
| 3,702,165 | 11/1972 | Carow et al. | 222/153 |
| 3,851,805 | 12/1974 | Hazard | 222/534 |
| 3,863,818 | 2/1975 | Hazard | 222/531 |
| 3,873,005 | 3/1975 | Hazard | 222/153 |
| 3,874,562 | 4/1975 | Hazard | 222/209 |
| 3,874,568 | 4/1975 | LaVange et al. | 222/505 |
| 3,881,643 | 5/1975 | LaVange | 222/505 |
| 3,884,392 | 5/1975 | Hazard | 222/153 |
| 3,884,394 | 5/1975 | Hazard | 222/153 |
| 3,893,593 | 7/1975 | Hazard | 222/48 |
| 3,907,174 | 9/1975 | Steiman | 222/321 |
| 4,015,756 | 4/1977 | Beck | 222/534 |
| 4,081,108 | 3/1978 | Wilson et al. | 222/153 |
| 4,124,150 | 11/1978 | Moss | 222/494 |
| 4,124,151 | 11/1978 | Hazard | 222/498 |
| 4,172,540 | 10/1979 | Erichson | 222/517 |
| 4,209,114 | 6/1980 | Wilson et al. | 222/536 |
| 4,209,115 | 6/1980 | Stahl | 222/536 |
| 4,219,138 | 8/1980 | Hazard | 222/534 |
| 4,241,855 | 12/1980 | Yoshioka | 222/479 |
| 4,272,228 | 6/1981 | Kutik et al. | 222/38 X |
| 4,282,991 | 8/1981 | Hazard | 222/531 |
| 4,320,859 | 3/1982 | Shy | 222/536 X |
| 4,440,327 | 4/1984 | Dark | 222/530 |
| 4,457,454 | 7/1984 | Meshberg | 222/383 X |
| 4,474,313 | 10/1984 | Sieverding | 222/386 X |
| 4,522,317 | 6/1985 | Goncalves | 222/532 X |
| 4,533,069 | 8/1985 | Drobish | 222/209 |
| 4,550,864 | 11/1985 | Tarozzi et al. | 222/532 X |
| 4,564,130 | 1/1986 | Eulenburg | 222/207 |
| 4,565,306 | 1/1986 | Nakanishi et al. | 222/383 |
| 4,640,442 | 2/1987 | Drobish | 222/209 |
| 4,657,161 | 4/1987 | Endo et al. | 222/383 X |
| 4,671,432 | 6/1987 | Benecke et al. | 222/405 X |
| 4,679,712 | 7/1987 | Foster et al. | 222/384 |

BIMODAL STORAGE AND DISPENSING PACKAGE FOR FLUENT MATERIAL

This is a continuation of application Ser. No. 209,126, filed on 6/22/88, now abandoned, which is a continuation of application Ser. No. 803,269 filed on 11/27/85, now abandoned.

TECHNICAL FIELD

The present invention relates to a storage and dispensing package for fluent material.

The present invention has further relation to such a package having a first mode of operation capable of storing said fluent material without leakage when the package is subjected to unintentional external forces and a second mode of operation capable of dispensing the fluent material when the package is subjected to external forces intentionally applied by the user.

The present invention has still further relation to such a package wherein the second mode of operation is capable of automatically isolating substantially all of the fluent material remaining in the package from the surrounding atmosphere as soon as the intentionally applied external forces are removed.

Finally, the present invention has relation to such a package which is particularly suited to storage and dispensing of fluent materials such as dentifrice, shampoo, facial creams, shaving creams and the like.

BACKGROUND ART

Packages for dispensing fluent materials by employing self-closing discharge nozzles are known in the art. For example, U.S. Pat. No. 2,071,657 issued to Richardson on February 23, 1937 discloses a collapsible tube employing a self-closing nozzle employing a pair of self-closing jaws. The jaws, which open to form an orifice in response to pressure of the fluent material, close off the discharge end of the tube when the pressure of the fluent material inside the container is relieved.

Another exemplary structure of this type is shown in U.S. Pat. No. 3,506,163 issued to Rauh et al. on April 14, 1970. The patent to Rauh et al. discloses a collapsible container for a flowable material. The container includes a normally closed spout which opens automatically in response to a pressure increase inside the container. At the end of any given product dispensing cycle, the spout automatically assumes its closed position, thus maintaining the flowable material within the container out of contact with the atmosphere and preventing the container from expanding back to its initial volume. The container of Rauh et al. is progressively collapsed as the flowable material is dispensed.

A practical difficulty experienced with structures of the aforementioned type is that they will dispense fluent material in response to an increase in pressure whenever external forces are applied to the container. Accordingly, some type of mechanical closure must be utilized during the filling, handling and shipping of such packages to avoid unwanted material discharge during these necessary operations. Furthermore, in the event the mechanical closure mechanism utilized to ensure a seal during the filling, handling and shipping stages becomes lost or discarded after the user places the package in service, the package cannot practically be restored to a leak-proof condition. Thus packages of the aforementioned type may not practically be employed in a travel bag or the like once the closure mechanism has become lost or separated therefrom.

Dispensing packages, particularly dispensing closures, having integral valve means which are not responsive to pressure of the package contents are also generally known in the art. The valve means in such closures often comprises a rotatable turrent which in a first position prevents discharge of the package contents regardless of the pressure to which the package is subjected and which in a second position freely permits discharge of the package contents in response to increased pressure of the package contents.

Typical of such dispensing closures are the structures shown in U.S. Pat. No. 3,568,895 issued to Porter on March 9, 1971; U.S. Pat. No. 3,874,562 issued to Hazard on April 1, 1975; U.S. Pat. No. 4,282,991 issued to Hazard on August 11, 1981; and U.S. Pat. No. 4,440,327 issued to Dark on April 3, 1984. The aforementioned references disclose various forms of turrets which are rotatable in a vertical plane.

Dispensing closures having turret mechanisms which are rotatable in a horizontal plane are also generally known. Structures of the type disclosed in U.S. Pat. No. 2,880,914 issued to Lerner et al. on April 7, 1959 and U.S. Pat. No. 3,162,333 issued to Davidson on December 22, 1964 are typical of structures employing such horizontally rotatable turrets.

While structures employing multi-position valves, particularly valves of the turret type do permit easier filling, handling and shipping of fluent materials, they are nonetheless prone to problems once the user places them in service. In particular, spillage of the fluent material may occur if the package is tipped over or dropped while the valve is in the "open" position. Furthermore, if the user forgets to close the valve after dispensing fluent material from the package, dryout and clogging of the valve passageways and the material inside the package is likely to occur. Since there is no positive cutoff of product when the dispensing cycle ceases, dripping of fluent material from the package is also likely to occur after the dispensing cycle has been completed.

OBJECTS OF THE INVENTION

It is therefore an object of the present invention to provide a storage and dispensing package which overcomes the aforementioned problems of the prior art structures.

It is a further object of the present invention to provide a storage and dispensing package for fluent material, said package having a first mode of operation capable of storing said fluent material without leakage when the package is subjected to unintentional external forces and a second mode of operation capable of dispensing the fluent material when the package is subjected to external forces intentionally applied by the user.

It is another object of the present invention to provide such a package wherein the second mode of operation is capable of automatically isolating substantially all of the fluent material remaining in the package from the surrounding atmosphere as soon as the intentionally applied external forces are removed.

It is still another object of the present invention to provide such a package which prevents leakage of the fluent material contained within the package without the use of any ancillary closure mechanism and without the need for the user to take any particular action once the dispensing cycle has been completed.

It is still another object of the present invention to provide such a package which is simple to manufacture, yet highly reliable for its intended purpose.

DISCLOSURE OF THE INVENTION

In a particularly preferred embodiment, the present invention comprises a storage and dispensing package for fluent material. The package has a first mode of operation capable of storing the fluent material without leakage when the package is subjected to unintentionally applied external forces. The package also has a second mode of operation capable of dispensing the fluent material when the package is subjected to external forces intentionally applied by the user. The second mode of operation is also capable of automatically isolating substantially all of the fluent material remaining in the package from the surrounding atmosphere as soon as the intentionally applied external forces are removed.

In a particular preferred embodiment the package comprises container means for housing the fluent material, means for applying pressure to the fluent material in the container by applying external forces to the package, and a fluid conduit for transporting the fluid material from the interior of the container to the exterior of the container. The fluid conduit has an inlet end for receiving the fluent material from the container and a discharge end remote from its inlet end. The package includes a first valve which does not open in response to pressure of the fluent material in the container located at the inlet end of the fluid conduit. The first valve has a "closed" position which corresponds to the first mode of operation and which prevents fluid communication between the fluent material in the container and the inlet end of the fluid conduit regardless of the pressure applied to the fluent material. The first valve also has an "open" position which corresponds to the second mode of operation and which permits fluid communication between the fluid material in the container and the inlet end of the fluid conduit. The first valve also includes means for manually switching the valve between the "closed" and the "open" positions. A second valve is located at the discharge end of the fluid conduit, the second valve being normally closed to prevent fluid communication between the fluent material contained in the fluid conduit and the surrounding atmosphere. The second valve is openable only in response to pressure applied by the fluent material in the fluid conduit and is automatically closable whenever the pressure on the fluent material in the fluid conduit is relieved.

Leak resistant handling, shipping and storage of the fluent material contained in the storage and dispensing package of the present invention can be carried out while the first valve is in its "closed" position. Dispensing of the fluent material from the package can be carried out while the first valve is in its "open" position by intentionally applying external forces to the container to pressurize the fluent material in the container and the fluid conduit.

Pressure on the fluent material in the fluid conduit will be automatically relieved whenever the external forces are removed from the package or whenever the valve is manually switched from its "open" to its "closed" position.

In a particularly preferred embodiment of the present invention the inlet end of the fluid conduit comprises a rotatable turret formed by complementary portions of the fluid conduit and the container, and the first valve comprises a first movable orifice in the fluid conduit portion of the turret which aligns with a second stationary orifice in the container portion of the turret only when the first valve is in its "open" position.

The discharge end of the fluid conduit is preferably fitted with a self-closing valve which opens only in response to pressure of the fluent material in the conduit. The first valve is switched between its "open" and "closed" positions by manually moving the fluid conduit back and forth.

In a particularly preferred embodiment the first valve is configured so that it is in its "off" position when the fluid conduit is vertically aligned, i.e., substantially parallel to the vertical axis of the container. This permits use of a closure member, such as an overcap, having a cross-section which is substantially identical to the cross-section of the container, as measured perpendicular to the vertical axis thereof. The valve is opened by rotating the fluid conduit approximately 90°, thereby positioning the discharge end of the fluid conduit and the second pressure responsive, self-closing valve outside the cross-sectional confines of the container, as viewed along the vertical axis of the container. This facilitates one handed dispensing of the package contents without the need to pick up the container during the dispensing cycle.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE PRESENT INVENTION

Figure 1:
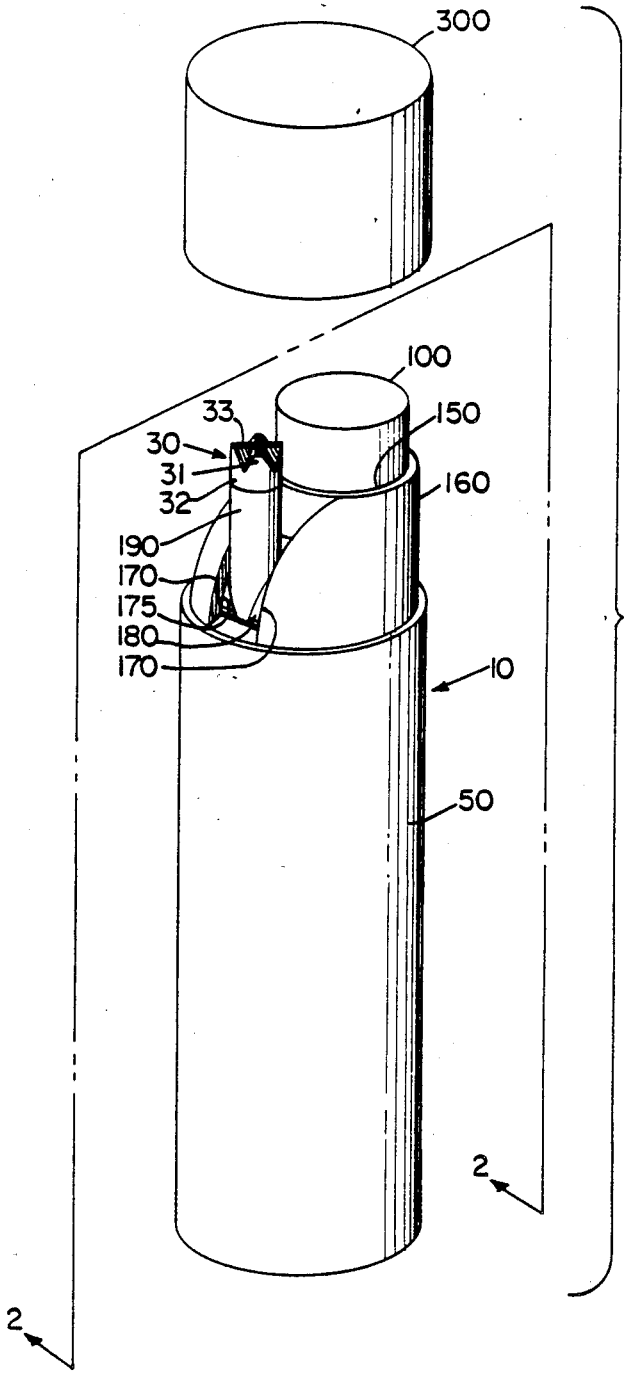
FIG. 1 is a simplified perspective representation of a preferred storage and dispensing package of the present invention.

Referring now to the drawings, wherein like numerals indicate like elements throughout the views, FIGS. 1-9 illustrate a pump-type storage and dispensing package 10 which includes a container body 50, a manually operable push button 100 which operates vertically within the confines of a complementary shaped cylindrical portion 160 of the uppermost end of the container body and a pressure responsive self-sealing dispensing valve 30 located at the discharge end of a fluid conduit 190. The inlet end of the fluid conduit 30 includes a non-pressure responsive valve which, in its "closed" position, prevents fluid communication between the fluent material 40 inside container body 50 and the inlet end of the fluid conduit even when substantial pressure is applied to the fluent material inside the container body.

In the embodiment shown in FIGS. 1-9, the fluid conduit 190 is pivotally connected to a pair of horizontally opposed trunnions 170 located at the uppermost end of the container body 50 by means of a horizontally oriented cylindrical member 180 which extends into a pair of cylindrical openings 175 located on the opposed interior faces of the trunnions 170. If the trunnions 170 and the cylindrical member 180 are formed of molded plastic, assembly of the member 180 into the cylindrical openings 175 of the trunnions may be accomplished by slightly deforming the trunnions 170, the cylindrical member 180 or both.

Figure 3:
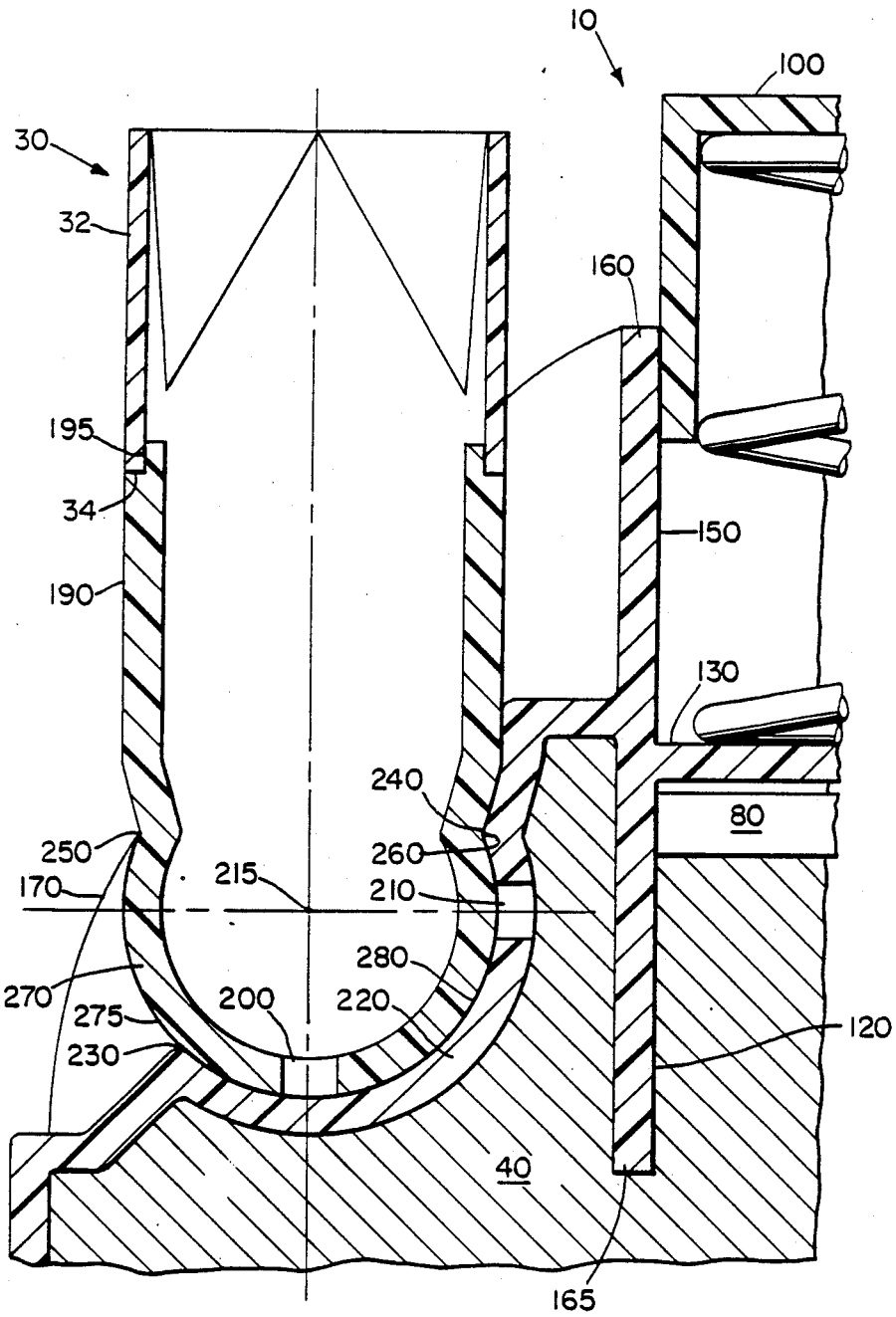
FIG. 3 is a greatly enlarged cross-sectional view of the fluid conduit portion of the package generally shown in FIGS. 1 and 2 in its "closed" position.

As can best be seen in the cross-section of FIG. 3, the uppermost end of container body 50 includes an arcuate portion 220 which is cylindrical in cross section and extends from outermost point 230 to innermost point 240. Arcuate portion 220 includes a single orifice 210 coinciding with the horizontal centerline extending through the axis of rotation 215 of fluid conduit 190. The inlet end of fluid conduit 190 includes a complementary-shaped arcuate portion 270 which is also cylindrical in cross section and which extends from point 250 to point 260, as generally shown in FIG. 3. Arcuate portion 270 includes an orifice 200 which coincides with the vertical centerline passing through the axis of rotation 215 of fluid conduit 190 when the fluid conduit is in the orientation generally shown in FIG. 3, i.e., when the conduit is in its "off" position.

Figure 5:
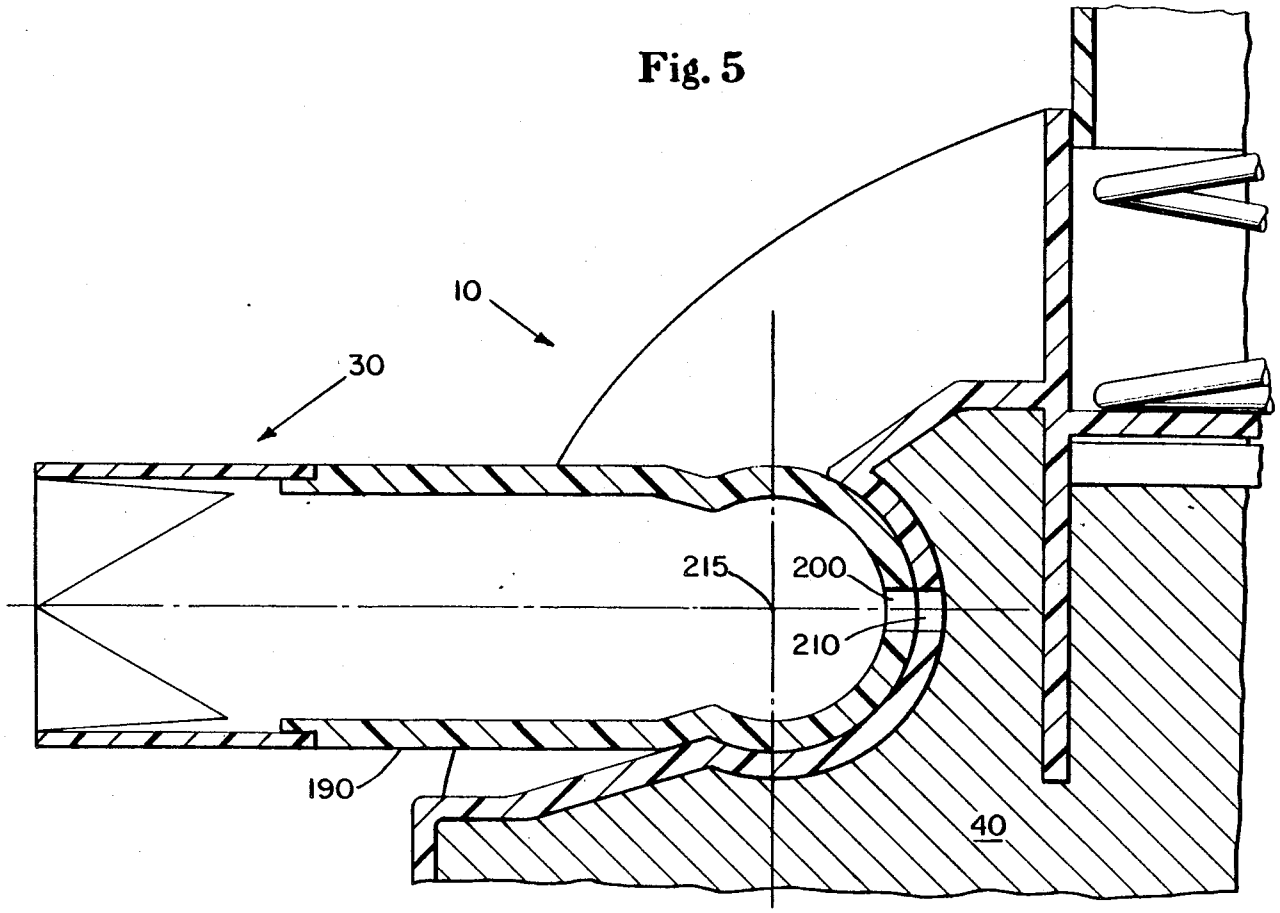
FIG. 5 is a simplified cross-sectional illustration of the fluid conduit portion of the dispenser shown in FIG. 4 taken along section line 5—5 of FIG. 4.

As will be appreciated, outermost cylindrical surface 275 of arcuate portion 270 of fluid conduit 190 slides against complementary-shaped exterior surface 280 of arcuate portion 220 of container body 50 when fluid conduit 190 is rotated from the "off" position shown in FIG. 3 to the "open" position shown in FIG. 5. Because orifice 210 in arcuate portion 220 of container body 50 and orifice 200 in arcuate portion 270 are 90° apart in the "off" position shown in FIG. 3, any pressure applied to the fluent material 40 inside container body 50 will not cause the material to exit via orifice 210 due to the presence of arcuate portion 270 which effectively blocks orifice 210. Because the cylindrical member 180 to which fluid conduit 190 is joined is restrained from movement away from orifice 210 by virtue of its being constrained within the cylindrical openings 175 located on the innermost faces of opposing trunnions 170, the valve thus formed is substantially non-pressure responsive. While it would of course be possible to apply forces to the package which are sufficient to damage or destory the valve by overpressure and thereby cause discharge of fluent material from within, the magnitude of the external forces required is much greater than those normally experienced in conventional filling, shipping and handling operations. Thus, as used herein, a non-pressure responsive valve is one which resists leakage at pressures which are less than those required to damage or destroy the valve.

Dispensing package 10 can be reliably filled, handled, transported and stored without fear of leakage even if the fluent material 40 contained therein is subjected to unintentional increases in pressure, such as might be caused by non-destructive deformation of container body 50 or inadvertent actuation of push button 100.

Figure 2:
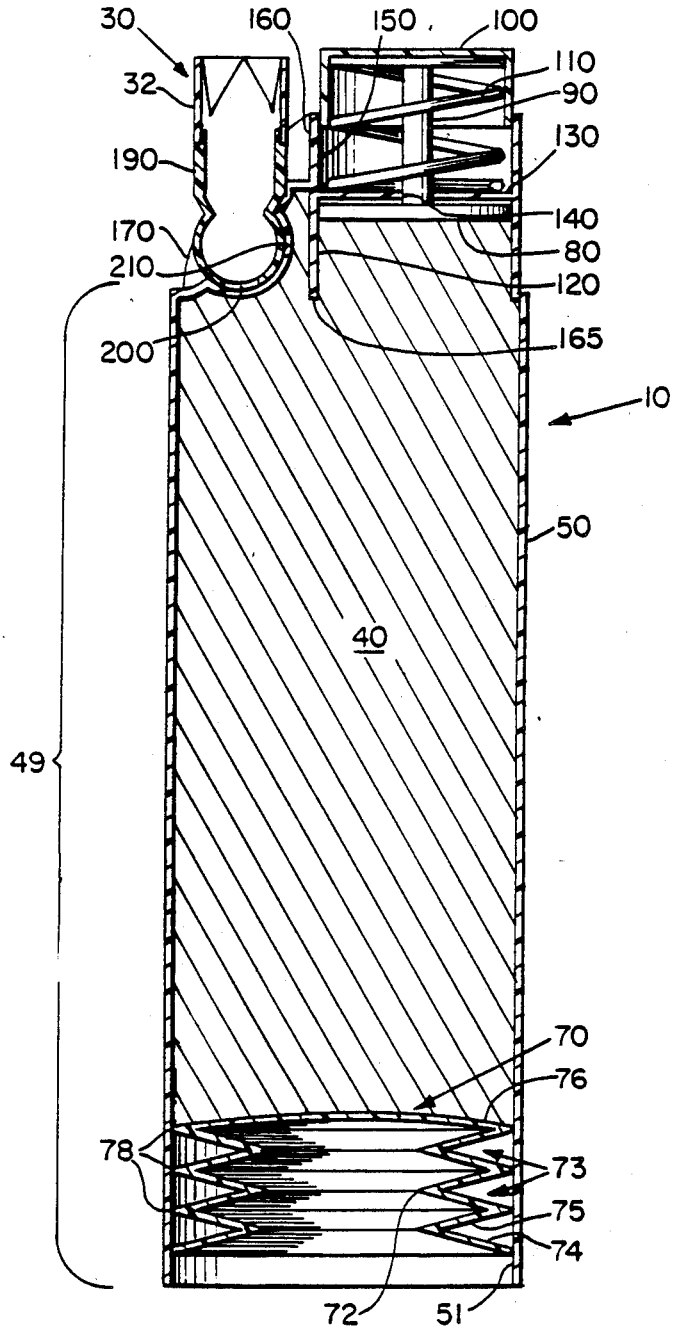
FIG. 2 is a simplified cross-sectional illustration of the dispenser shown in FIG. 1 taken along section line 2—2 of FIG. 1.
Figure 4:
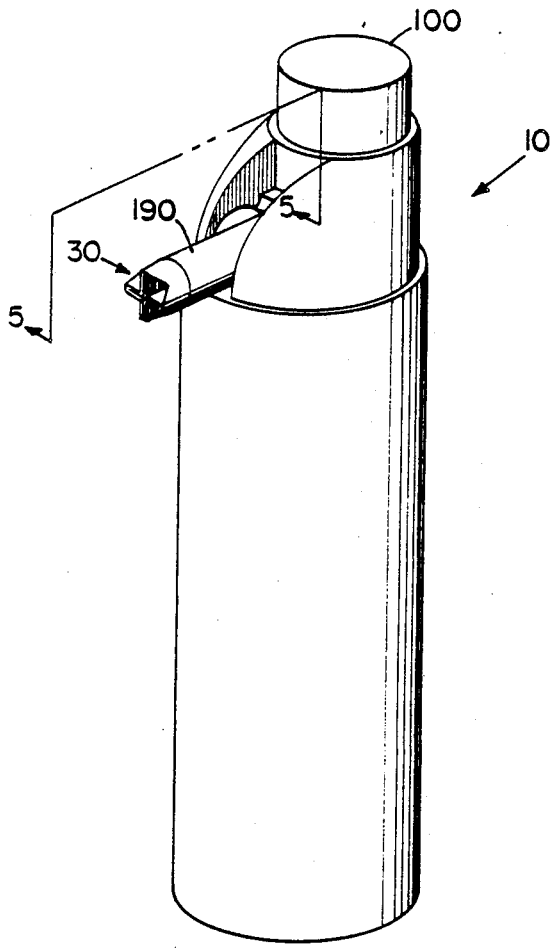
FIG. 4 is a simplified perspective representation of the container generally shown in FIG. 1 after the fluid conduit has been rotated to a horizontally extending "open" position.

The fluid conduit 190 is generally shown in FIGS. 1–3 with the non-pressure responsive valve formed by arcuate portion 270 of fluid conduit 190, arcuate portion 220 of container body 50 and orifices 200 and 210, respectively, in the "off" position. In FIG. 4, the fluid conduit 190 is shown with the non-pressure responsive valve rotated 90° to its "on" position. Rotating the fluid conduit 190 to a horizontal position aligns orifice 200 in arcuate portion 270 of the fluid conduit with orifice 210 in arcuate portion 220 of container body 50, as shown in greatly enlarged form in the cross-section of FIG. 5. With orifices 200 and 210 in horizontal alignment along the horizontal centerline passing through the axis of rotation 215 of fluid conduit 190, any pressure applied to fluent material 40 inside container body 50 will cause the fluent material to pass through apertures 210, 200 and to enter the inlet end of fluid conduit 190.

The pressure of fluent material 40 inside container body 50 is normally increased by manual actuation of pushbutton 100, which is connected by means of a shaft 90 to a pressurizing piston 80. As can be seen from the cross-section of FIG. 2, pushbutton 100, which is preferably cylindrical in shape is free to travel up and down the internal bore 150 of cylindrical portion 160 of the uppermost end of container body 50. A horizontal wall member 130 separates uppermost cylindrical portion 160 from a lowermost cylindrical portion 165. Lowermost cylindrical portion 165 has an internal cylindrical bore 120 against which pressurizing piston 80 slides. Horizontal wall member 130 includes a centrally located aperture 140 through which shaft 90 passes. Seal means (not shown) may, if desired, be employed to prevent leakage of any fluent material which gets past pressurizing piston 80 between aperture 140 and shaft 90. A vertically oriented compression spring 110 is located intermediate horizontal wall member 130 and the interior surface of pushbutton 100. The vertically oriented spring 110 returns the pushbutton 100 to its undepressed condition whenever the manual forces used to dispense fluent material 40 from the package 10 are removed from the pushbutton 100.

Fluent material 40 is preferably prevented from passing around pressurizing piston 80 by means of a sliding seal between the pressurizing piston and the internal bore 120 of cylindrical member 165. Alternatively, a rolling diaphragm member employing a static seal can be substituted by securing the center of the diaphragm to the face of pressurizing piston 80 and the perimeter of the diaphragm to a suitable point located on the interior of the container body 50. As will be appreciated by those skilled in the art, plunger actuated pressurizing means of various types are known in the art. Because the particular method of pressurizing the fluent material 40 within container body 50 is not critical to the practice of the present invention, further details of suitable alternative pressurizing means have not been provided herein.

The container body 50 of storage and dispensing package 10 of the present invention may be constructed of any substantially rigid material (such as metal, paperboard, plastic or composite structures combining two or more of these materials). It preferably comprises a tubular portion 49 which is open at its lowermost end. The tubular portion 49 preferably has a circular axial bore 51 therethrough, but the inner cross-section of such bore can be of any desired shape (such as square, rectangular, or oval). A circular bore is generally preferred because it is difficult to establish a seal around a piston having different configuration.

While absolute rigidity of tubular portion 49 is not essential, substantial rigidity is preferred because the volume of fluent product 40 dispensed from the package will be affected during any particular dispensing operation by changes of volume permitted by nonrigid structures. Moreover, rigidity helps ensure substantially parallel inner wall surfaces for proper sealing with the follower piston 70. Plastic (e.g., polypropylene, polyacrylonitrile or polyethylene terephthalate) is a preferred material for tubular portion 49 as it provides expediency and ease in the manufacturing process.

In the embodiment shown in FIGS. 1–9, a one-way follower piston 70 preferably made of polypropylene or polyethylene (although any resilient material will suffice) is slidingly mounted within the tubular portion 49 of container body 50 of dispensing package 10. In the illustrated embodiment, piston 70 exhibits a convex face 76 integrally attached about its lower outer periphery to a depending sidewall including thin walled, bellows-like concavities or corrugated segments 73. Each individual concavity (or bellows) 73 is made up of one upwardly facing frustoconically shaped wall section 74 and one downwardly facing frustoconically shaped wall section 75, said sections being hingedly connected at their intersection 72. The individual concavities 73 are connected to one another at their upper and lower extremes by an integral contact band 78, and the uppermost bellows is similarly connected to the lower outer periphery of the piston face 76 along a separate peripheral contact band 78. As can be seen in the cross-sectional view of FIG. 2, follower piston 70 is hollow and the inner surfaces of piston face 76 and the depending sidewall and its concavities 73 are exposed to ambient air via circular axial bore 51 as a result of the open bottom of follower piston 70. This permits longitudinal extension or contraction of the piston sidewall without interference of air which might otherwise be trapped within the piston during the dispensing cycle. While the storage and dispensing package embodiment 10 shown in FIG. 2 employs an open bottom at the lowermost end of circular axial bore 51, the bottom of the package could, if desired, be closed, provided means are included for venting the area beneath follower piston 70. For example, a vented bottom closure (not shown) could be applied to the bottom of container body 50 after the container has been filled from the bottom and the follower piston 70 inserted.

Figure 6:
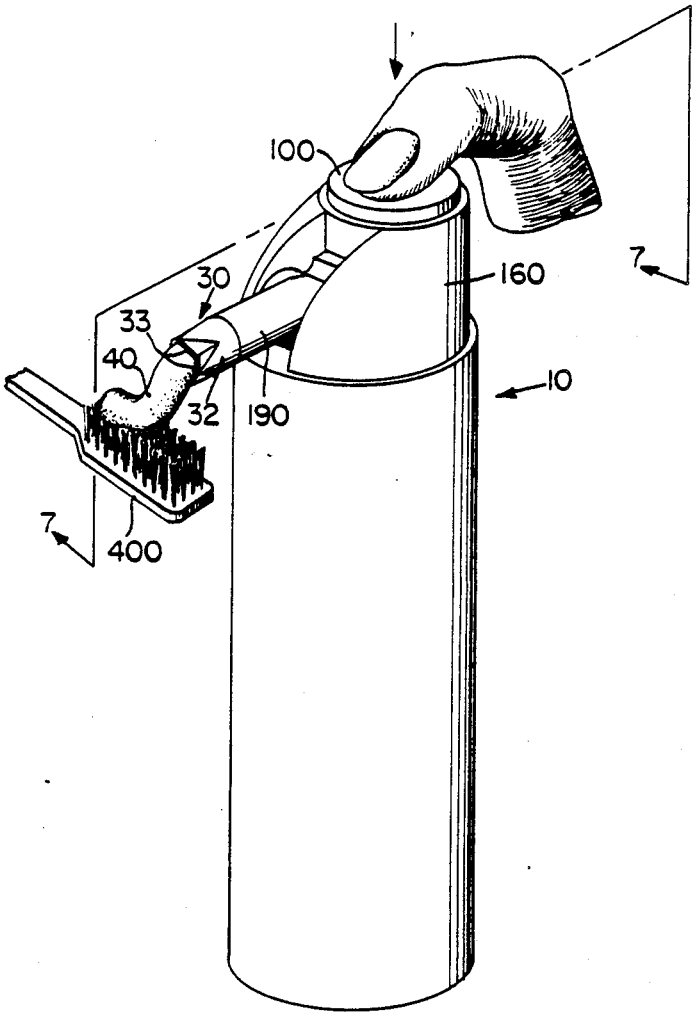
FIG. 6 is a simplified perspective representation of the storage and dispensing package shown in FIG. 4 as the user's finger is applying force to the package to pressurize the fluent material inside and discharge the material through the fluid conduit onto an object such as a toothbrush.

The resilient concavities 73 of follower piston 70 permit piston 70 to be longitudinally compressed in response to downward pressure exerted on piston face 76. In an unrestricted environment this results in a proportional expansion of the outer diameters of contact bands 78. Thus when pushbutton 100 is downwardly actuated as generally shown in FIG. 6, follower piston 70 is longitudinally compressed, thereby forcing one or more contact bands 78 into tighter engagement with the interior bore 51 of the tubular portion 49 of container body 50. Since follower piston 70 cannot retreat when longitudinally compressed, a downward force "F" applied to manually operated pushbutton 100 pressurizes fluent material 40, thereby forcing its entry via aligned orifices 210,200 into the inlet end of fluid conduit 190, as generally shown in the simplified cross section of FIG. 7.

Once the fluent material 40 has filled the interior of fluid conduit 190, it reaches the innermost surface of a pressure responsive self-sealing valve or nozzle 30. The self-sealing valve or nozzle 30 can comprise any check valve which permits extrusion of fluent material outwardly under pressure and which provides for clean cut-off and sealing upon release of the pressure. In the illustrated embodiment, pressure responsive self-sealing valve or nozzle 30 is preferably injection molded of silicone rubber (e.g., SILASTIC® LSR-595 or SILASTIC® MDX 4-4526 available from Dow Corning of Midland, Michigan), although a wide variety of materials and forming procedures can be used. While elastomeric materials of construction are generally preferred for self-sealing valve or nozzle 30, any resilient material which can be molded into the desired configuration may, if desired, be employed, e.g., polyethylene terephthalate, ethylene methyl acrylate, laminates comprised of polyethylene terephthalate and Hytrel® (available from DuPont of Wilmington, Delaware) or the like.

The valve or nozzle 30 shown in the embodiment of FIGS. 1–9 comprises four leaves or flutes 31. However, it is contemplated that alternate nozzles of varying structures and number of leaves can be successfully utilized to provide a combination check valve and a self-sealing closure for storage and dispensing package 10. As can be seen in FIGS. 1, 2 and 3, the nozzle 30 has an interior surface which is formed with a generally cylindrical open inlet end 32 and an outlet end which terminates in interconnected closed slits 33 intermediate the individual flutes 31. In the illustrated embodiment, the innermost end 34 of valve or nozzle 30 is secured to a peripheral groove 195 located at the discharge end of fluid conduit 190 by any suitable means, e.g., complementary grooves and projections extending about the periphery of the valve and the fluid conduit (not shown), a peripherally extending heat shrink band (not shown), a peripherally extending band of tape (not shown), a compatible adhesive (not shown), heat sealing or the like. The particular method of valve securement is non-critical to the practice of the present invention. To prevent leakage when fluid conduit 190 is left in its "open" position, it is preferred that valve or nozzle 30 be molded with the flutes 31 closed at their distal end. The slits 33 are thereafter cut as desired to ensure that such slits will have the ability to fully close when pressure is removed from fluent material 40. This self-closing characteristic is also important because valve or nozzle 30 must be capable of preventing the flow of fluid, particularly air, into the storage and dispensing package 10.

While the particular type of self-sealing valve or nozzle employed in practicing the present invention is non-critical, one particularly preferred structure is disclosed in the copending, commonly assigned U.S. Patent Application of James Lee Drobish, Ser. No. 759,390, filed on July 26, 1985 and entitled IMPROVED DISPENSING PACKAGE AND FOLLOWER DEVICE, said Patent Application being hereby incorporated herein by reference.

It is of course recognized that the self-sealing valve or nozzle 30 can be designed to provide whatever desired opening pressure is required for the particular package and fluent material. Ideally the selected opening pressure should be such that the valve will readily close immediately upon release of the pressure applied to fluent material 40, yet not be so great that undue force is required to manually actuate pushbutton 100. It is, of course, further recognized that the amount of force "F" required to depress pushbutton 100 will be influenced by such factors as the strength of compression spring 110 which serves to return the pushbutton to its undepressed condition and the cross-sectional area of pressurizing piston 80.

Figure 7:
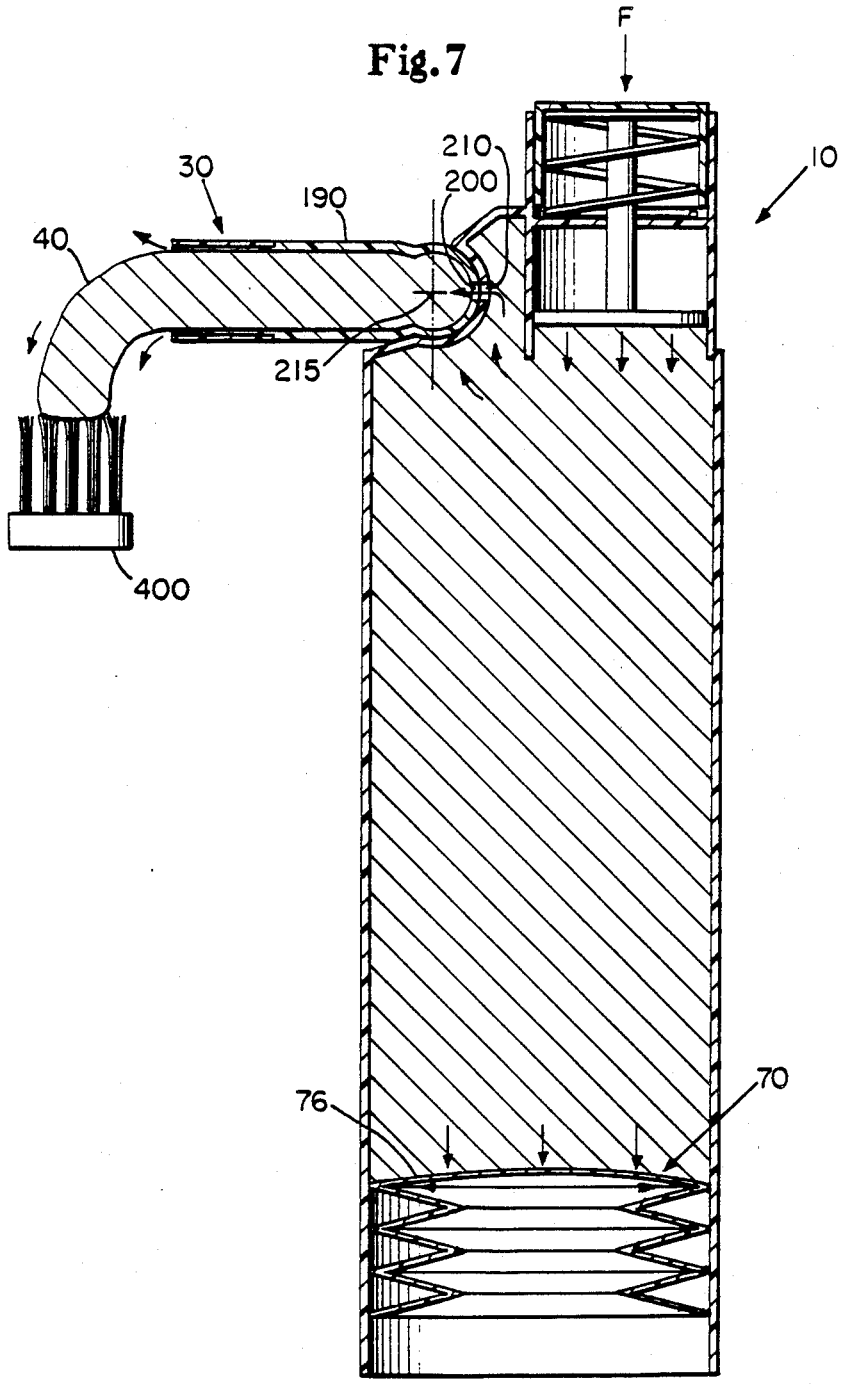
FIG. 7 is a simplified cross-sectional representation of the storage and dispensing package shown in FIG. 6 taken along section line 7—7 of FIG. 6.

In the condition illustrated in FIGS. 6 and 7, a downwardly exerted force "F" on pushbutton 100 pressurizes the fluent material 40 within container body 50 so as to force one or more contact bands 78 of follower piston 70 tightly against the interior bore 51 of tubular portion 49 of container body 50. In addition, it opens self-sealing valve or nozzle 30 to dispense the fluent material 40 through the separated slits 33 of flutes 31 and onto an object such as a toothbrush 400.

Figure 8:
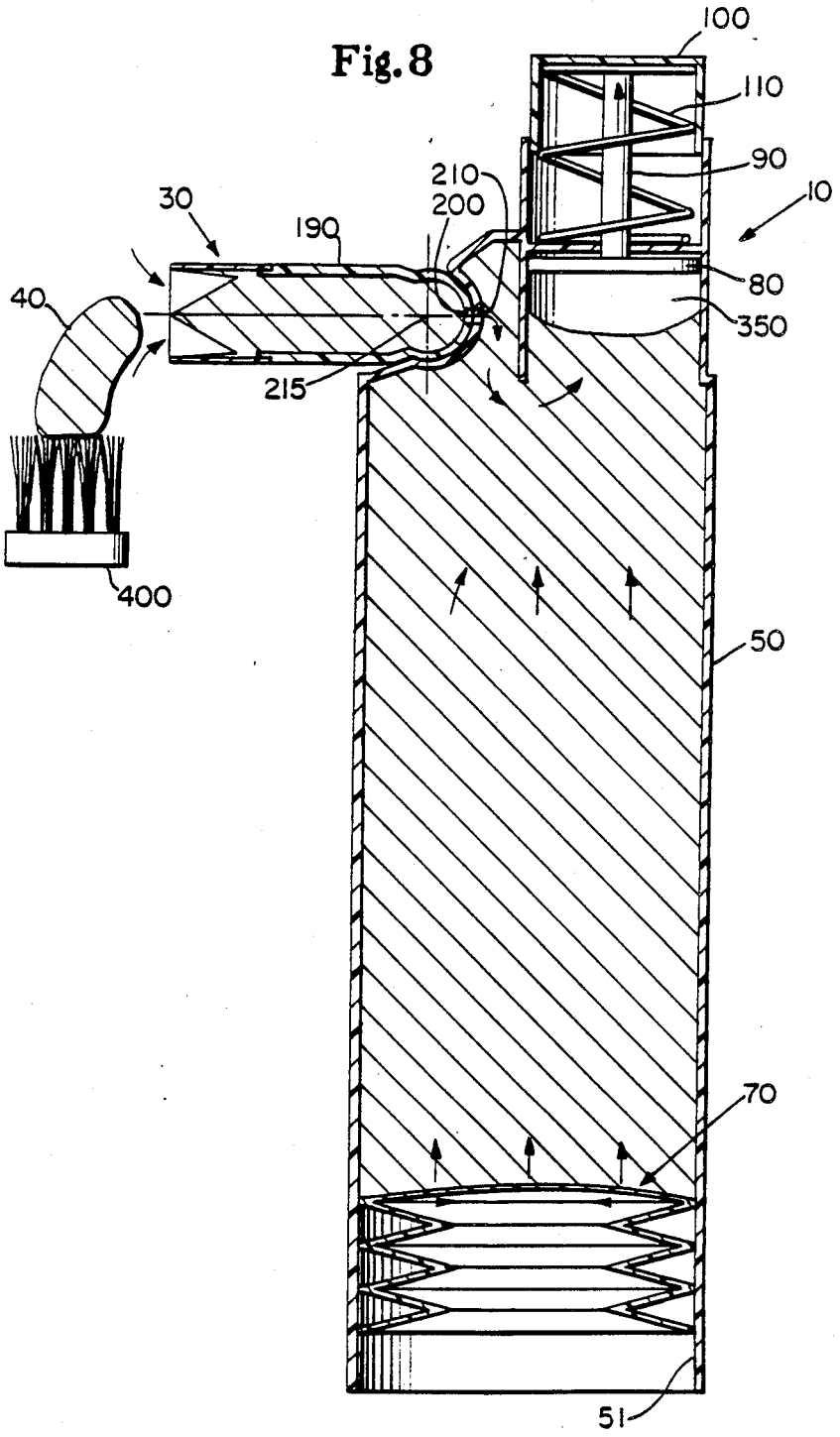
FIG. 8 is an illustration generally similar to that of FIG. 7, with the exception that the dispensing cycle has just been completed and the uppermost or pressurizing piston has returned to its at rest condition.
Figure 9:
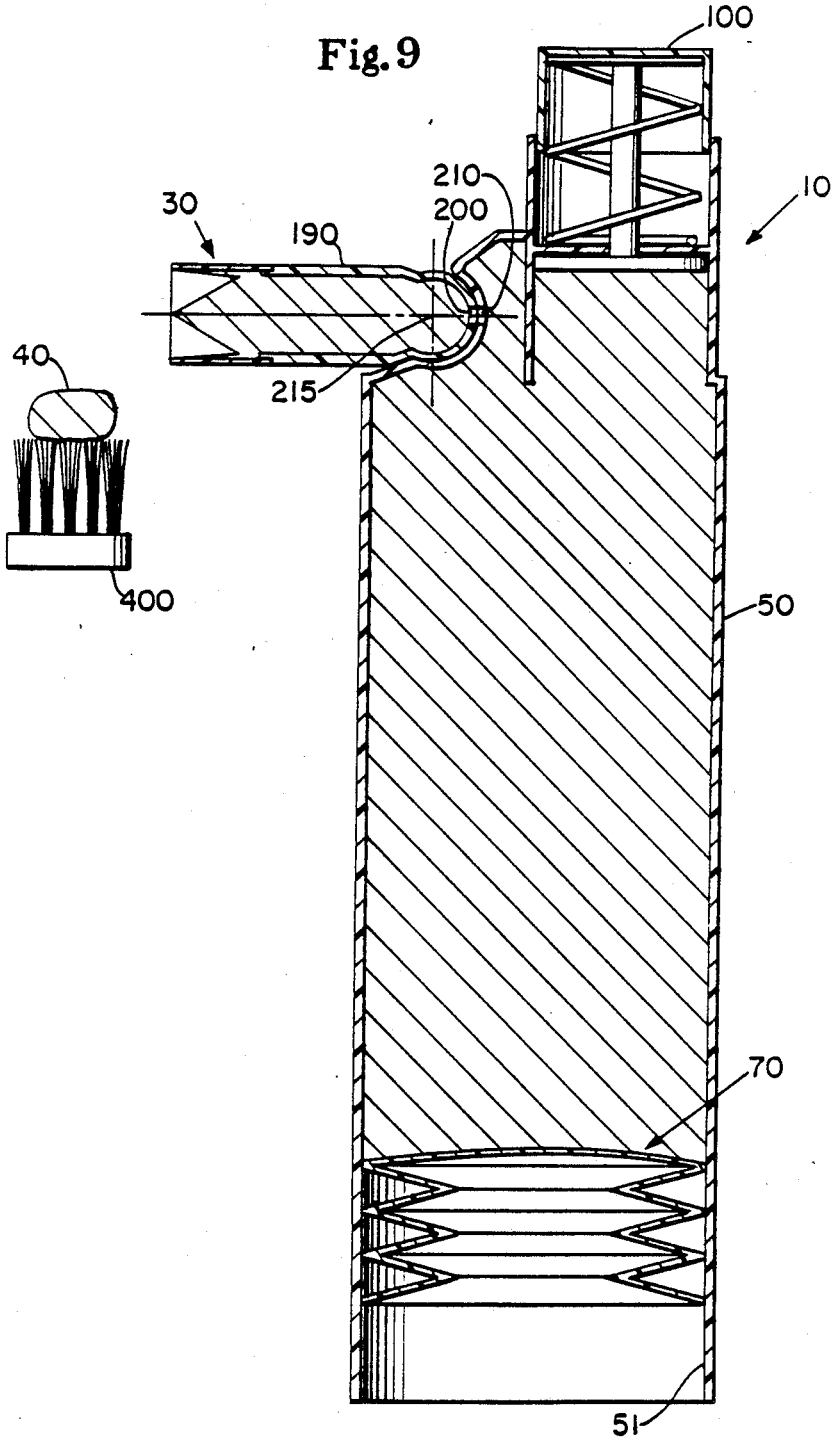
FIG. 9 is a cross-sectional illustration generally similar to that of FIG. 8, but showing the conditions existing inside the storage and dispensing package after the one-way piston located in the bottom of the package has advanced upwardly inside the tubular portion of the container body, thereby filling the void volume initially created by retraction of the uppermost pressurizing piston.

Once a sufficient quantity of fluent material 40 has been dispensed onto the brush 400, the user merely releases pushbutton 100, thereby creating the instantaneous condition illustrated in the cross-section of FIG. 8. Withdrawal of pressurizing piston 80 creates an instantaneous void space immediately beneath the piston within the lowermost cylindrical portion 165 of container body 50. Thus pressure is not only relieved on fluent material 40 in both container body 50 and fluid conduit 190, but the instantaneous void, indicated generally as 350 in FIG. 8, creates a suction within the container body 50. This assists instantaneous closure of slits 33 in self-sealing valve or nozzle 30 and, in addition, creates a lifting force on surface 76 of follower piston 70. The lifting force exerted on surface 76 of follower piston 70 tends to axially stretch piston 70, thereby relieving pressure between contact bands 78 and the interior bore 51 of tubular portion 49 of container body 50. The net result is that the follower piston 70 tends to advance upwardly inside the tubular portion 49 of the container body until the void space 350 instantaneously created in cylindrical portion 165 of the container body 50 has been substantially filled by the fluent material 40 remaining inside the container. As a result, the new equilibrium condition shown generally in the cross-section of FIG. 9 is established, and the storage and dispensing package 10 is again ready to dispense fluent material 40 when the pushbutton 100 is manually depressed.

While it is possible to practice the present invention with many alternative types of follower pistons, the one-way follower piston 70 generally shown in the embodiment of FIGS. 1–9 is particularly preferred. This piston is also described in greater detail in the copending, commonly assigned U.S. Patent Application of James Lee Drobish, Ser. No. 759,390, filed on July 26, 1985 and entitled IMPROVED DISPENSING PACKAGE AND FOLLOWER DEVICE, said Patent Application being incorporated herein by reference.

In the storage and dispensing package embodiments disclosed herein, the follower piston 70 is shown in direct fluid communication with the fluent material 40 inside container body 50. This is not a requirement of the present invention. It is, of course, feasible to provide a secondary chamber (not shown) within container body 50, said secondary chamber being directly exposed to the pressurizing piston 80 and indirectly exposed to the follower piston 70 via a check valve (not shown). The check valve closes when the pressurizing piston 80 is depressed and opens to admit fluent material into the secondary chamber each time the pressurizing piston 80 is retracted. The use of such a secondary chamber and check valve are particularly advantageous in situations where it is desired to use a more conventional follower piston which may be capable of movement in both directions. In addition, the use of such a secondary chamber and check valve may provide dispensing which is more directly responsive to the movement of pressurizing piston 80.

As will be appreciated from the foregoing description, the storage and dispensing package 10 of the present invention is capable of providing two distinct modes of operation. The first mode of operation is capable of storing the fluent material 40 without leakage when the package is subjected to unintentional external forces, while the second mode of operation is capable of dispensing the fluent material when the package is subjected to external forces intentionally applied by the user. The second mode of operation is also capable of automatically isolating substantially all of the fluent material remaining in the package from the surrounding atmosphere as soon as the intentionally applied external forces are removed.

While the exact configuration of the container for housing the fluent material and the means for applying pressure to the fluent material when it is intended to dispense the material from the package are noncritical, all embodiments of the present invention combine the aforementioned elements with a fluid conduit for transporting the fluent material from the interior of the container to the exterior of the container. The fluid conduit has an inlet end for receiving the fluent material from the container and a discharge end remote from the inlet end. The inlet end of the fluid conduit is provided with a first valve which, in its "closed" position, does not open in response to pressure of the fluent material inside the container. The "closed" position of the first valve corresponds to the first mode of operation of the package, since it prevents fluid communication between the fluent material inside the container and the inlet end of the fluid conduit regardless of the pressure applied to the fluent material. The first valve also has an "open" position which corresponds to the second mode of operation of the package, and which permits fluid communication between the fluent material inside the container and the inlet end of the fluid conduit. Means are also provided for manually switching the valve between its "closed" position and its "open" position. Importantly, storage and dispensing packages of the present invention also include a second valve located at the discharge end of the fluid conduit. The second valve is normally closed to prevent fluid communication between the fluent material contained in the fluid conduit and the surrounding atmosphere. The second valve is openable only in response to pressure applied by the fluent material in the fluid conduit, said second valve being automatically closable whenever the pressure on the fluent material in the fluid conduit is relieved.

By combining the aforementioned elements in the novel and unobvious manner descibed herein, a highly desired bimodal storage and dispensing package is provided. The package remains leak resistant during handling, shipping and storage of the fluent material when the non-pressure responsive first valve is maintained in its "closed" position. However, the same package permits easy, on-demand dispensing when the non-pressure responsive first valve is moved to its "open" position and external forces are intentionally applied to the container to pressurize the fluent material in both the container and the fluid conduit.

In the particularly preferred storage and dispensing package embodiment 10 illustrated in FIGS. 1–9, the fluid conduit 190 is an integral part of a turret mechanism. It permits vertical orientation of pressure responsive self-sealing valve or nozzle 30 when the axis of the fluid conduit 190 is aligned parallel to the axis of the tubular portion 49 of the container body 50 and horizontal orientation of the self-sealing valve or nozzle 30 when the axis of fluid conduit 190 is oriented substantially perpendicular to the axis of the tubular portion of the container body. Substantially vertical positioning of valve or nozzle 30 and fluid conduit 190 permits a package configuration wherein the fluid conduit is located completely within the transverse cross-sectional confines of the container body 50, as viewed along the vertical axis of the container body. This permits utilization of an overcap, such as overcap 300, having a transverse cross-section substantially coinciding with the transverse cross-sectional confines of the container body 50, as viewed along the vertical axis of the closure. In the illustrated embodiment, the closure 300 may be secured to the uppermost end of container body 50 by any of a number of releasable securement means well known in the art (and therefore not shown), such as mating sets of threads, interlocking grooves and protuberances or the like. While the optional closure 300 is shown only in conjunction with package embodiment 10, it will be understood that such a closure member may, if desired, be employed with any of the package embodiments which satisfy the aforementioned transverse cross-section criteria. For those package embodiments which do not satisfy the aforementioned transverse cross-section criteria it will of course be feasible to provide an overcap which is specially designed to accomodate any irregularity in transverse cross-section caused by an outwardly projecting fluid conduit and self sealing valve member. However, such a closure must be properly oriented prior to application to the package.

Location of the fluid conduit 190 completely within the cross-sectional confines of the container boby permits the manufacturer to use conventional filling, packing and handling techniques on the storage and dispensing packages 10 without a need for special orientation due to unusual protuberances which lie outside the cross-sectional confines of the container body. In addition, it permits storage and dispensing packages 10 of the present invention to be packed closely together and handled more reliably and with less difficulty at high speed.

A further advantage of storage and dispensing packages of the type shown in FIGS. 1–9 is that they permit convenient mess-free dispensing of the fluent material 40 contained therein. This is accomplished by rotating the self-sealing valve or nozzle 30 and the fluid discharge conduit 190 to which it is secured to a horizontal position. This switches the non-pressure responsive valve located at the inlet end of the fluid conduit to its "open" position. When the valve formed at the base of the turret is in its "open" position, the fluid conduit 190 and the valve or nozzle 30 secured to its discharge end project well beyond the cross-sectional confines of the container body 50, as generally illustrated in FIGS. 6, 7, 8 and 9. This permits an article such as toothbrush 400 to be positioned directly beneath the slits 33 in self-sealing valve 30. It is therefore unnecessary for the user to actually pickup the entire storage and dispensing package 10 to neatly and effectively dispense the fluent material 40 contained therein. This permits single handed countertop dispensing, as generally shown in FIG. 6, the other hand remaining free to hold the toothbrush 400.

Because the self-sealing valve 30 automatically closes to isolate the fluent material 40 in both fluid conduit 190 and container body 50 from the surrounding atmosphere as soon as pushbutton 100 is released, there is normally no need to return the non-pressure responsive first valve to its "off" position intermediate dispensing cycles. Thus in a typical environment, the storage an dispensing package 10 will remain in the position illustrated in FIGS. 6–9 once the consumer has placed the package in service. However, should it become necessary for the consumer to reseal the package to prevent inadvertent dispensing of the fluent material contents, e.g., as in a travelling situation, it is only necessary to reorient the fluid conduit 190 to a substantially vertical position as generally shown in FIGS. 1–3. This misaligns orifices 210 and 200 with one another, thereby preventing any fluent material 40 inside container body 50 from entering fluid conduit 190 until the first non-pressure responsive valve is again moved to its "open" position. Although some fluent material 40 will remain inside fluid conduit 190, there will be little tendency for the product to dryout, since valve 30 will remain closed unless the fluent material is pressurized. Inadvertent discharge of the material within fluid conduit 190 is also unlikely, since it would be extremely difficult to apply significant pressure to the fluent material 40 remaining inside the conduit 190 when the conduit is oriented in its vertical position. For added protection, the overcap 300, if desired, can be resecured to substantially restore the partially emptied package to its original leakproof condition.

From the foregoing it will be apparent that storage and dispensing packages of the present invention solve a heretofore unmet need by providing bimodal operation specifically suited to differing conditions of use experienced over the life of the package. An additional benefit provided by storage and dispensing packages of the present invention is their ability to neatly dispense discrete quantities of fluent material without contaminating the exterior surfaces of the self-sealing valve. Because the exterior of the self-sealing valve remains substantially free of any fluent material throughout the useful life of the package, there is minimal change for contamination by the surrounding environment intermediate dispensing cycles.

In FIGS. 10–13 there is shown an alternative embodiment of a storage and dispensing package 510 of the present invention. The storage and dispensing package 510 employs a pushbutton 100 operating within the uppermost cylindrical portion 160 of container body 50 in conjunction with a one-way follower piston 70 of the type generally illustrated in conjunction with embodiment 10 shown in FIGS. 1–9. Hoewver, in lieu of the rotary turret mechanism shown in the embodiment 10 of FIGS. 1–9, storage and dispensing package 510 employs a sliding "bayonnet" arrangement wherein a closed end cylindrical fluid conduit 590 is shown in its "closed" position in the condition generally illustrated in FIGS. 10 and 11.

Figure 10:
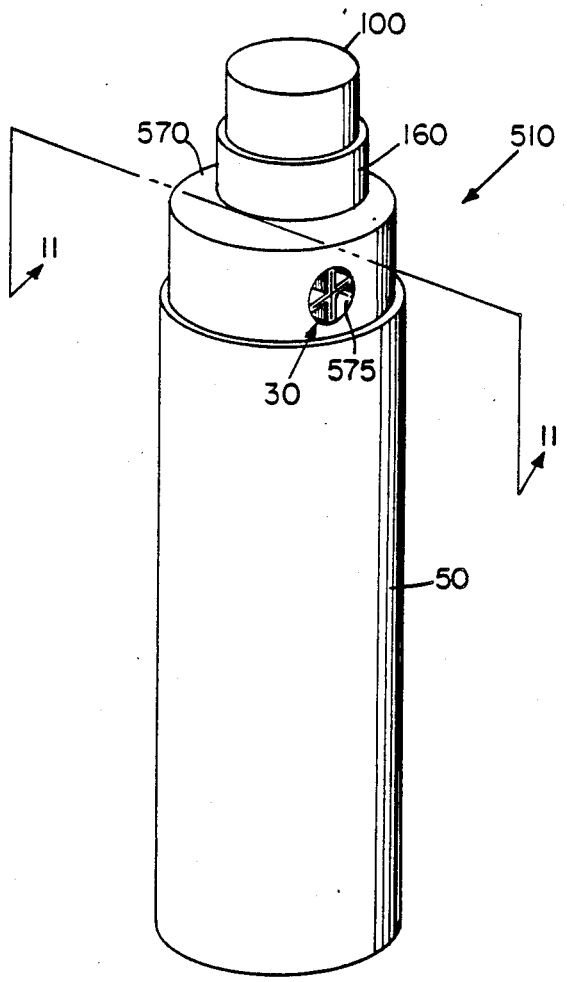
FIG. 10 is a simplified perspective representation of an alternative storage and dispensing package of the present invention with the fluid conduit in its "closed" position.
Figure 11:
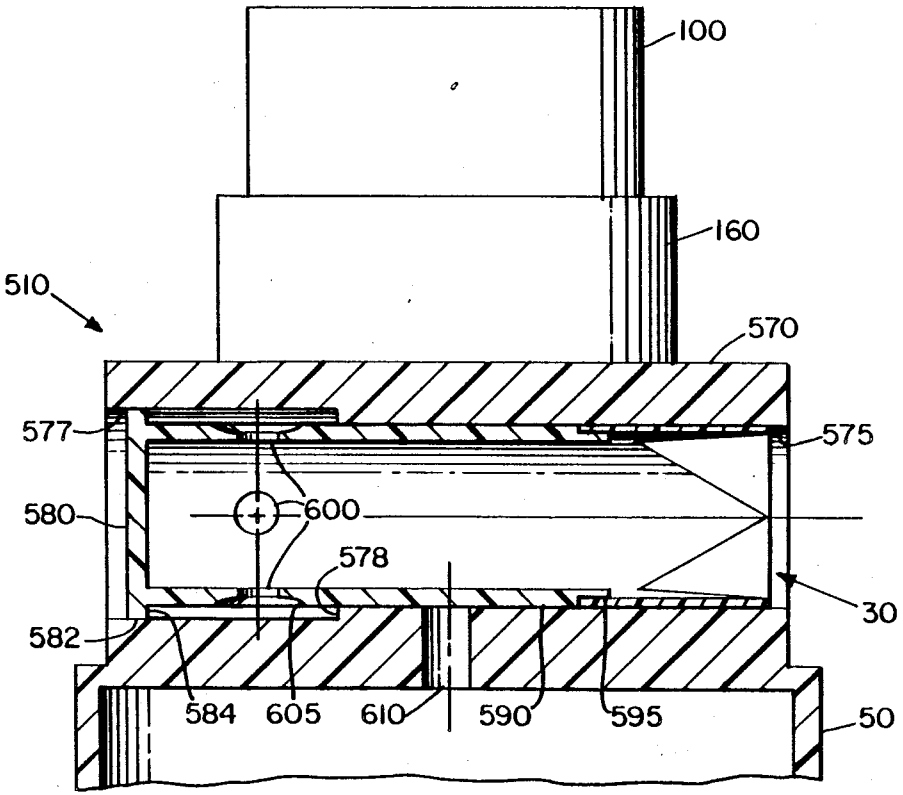
FIG. 11 is a greatly enlarged, simplified cross-sectional illustration through the fluid conduit portion of the storage and dispensing package generally shown in FIG. 10, said view being taken along section line 11—11 of FIG. 10.

In embodiment 510, cylindrical fluid conduit 590 is retracted within a pair of concentrically aligned cylindrical bores 577 and 575, as generally shown in the enlarged cross-section of FIG. 11. These aligned bores are provided in a "bayonet" housing 570 which replaces the turret trunnions used in the embodiment of FIGS. 1–9. The pressure responsive self-sealing valve 30 is identical to that utilized in the embodiment of FIGS. 1–9, as is the method of securement to the discharge end of fluid conduit 590. The outside diameter of cylindrical fluid conduit 590 is sized so as to provide a seal against the innermost walls of cylindrical bore 575. Accordingly, in the condition shown in FIGS. 10 and 11, orifice 610 which connects with container body 50 is blocked by the wall portion of the fluid conduit 590. The overall length of fluid conduit 590, including closed end wall 580 and self-sealing valve 30 is preferably such that it does not exceed the total overall length of cylindrical bores 577 and 575. This permits the fluid conduit 590 to be stored completely within the cross-sectional confines of the container body 50 in its "off" position.

To further guard against leakage, the end wall 580 of fluid conduit 590 is preferably sized so that its peripheral edge 582 forms a seal against the innermost surface of cylindrical bore 577, as generally shown in FIG. 11.

When the fluid conduit 590 is in its "closed" position, as generally shown in FIGS. 10 and 11, peripheral groove 605 which is provided in the exterior surface of the fluid conduit 590 and which includes a multiplicity of apertures 600 positioned about its periphery, is isolated from orifice 610 in cylindrical bore 575. The exact number of apertures 600 in peripheral groove 605 is noncritical, and it is feasible to utilize as few as one such aperture.

Figure 12:
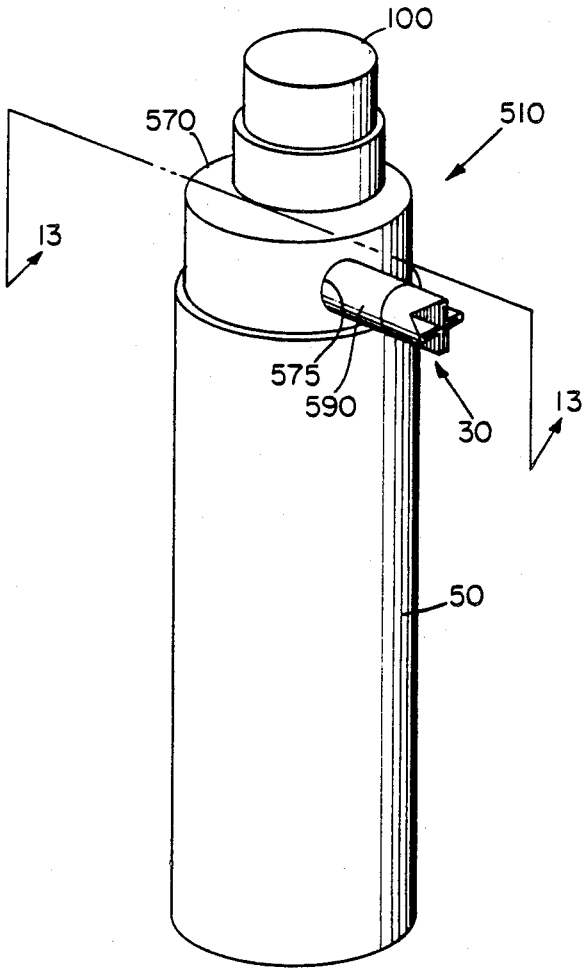
FIG. 12 is a simplified perspective representation of the dispenser shown generally in FIG. 10 after the fluid conduit has been moved to its "open" position.
Figure 13:
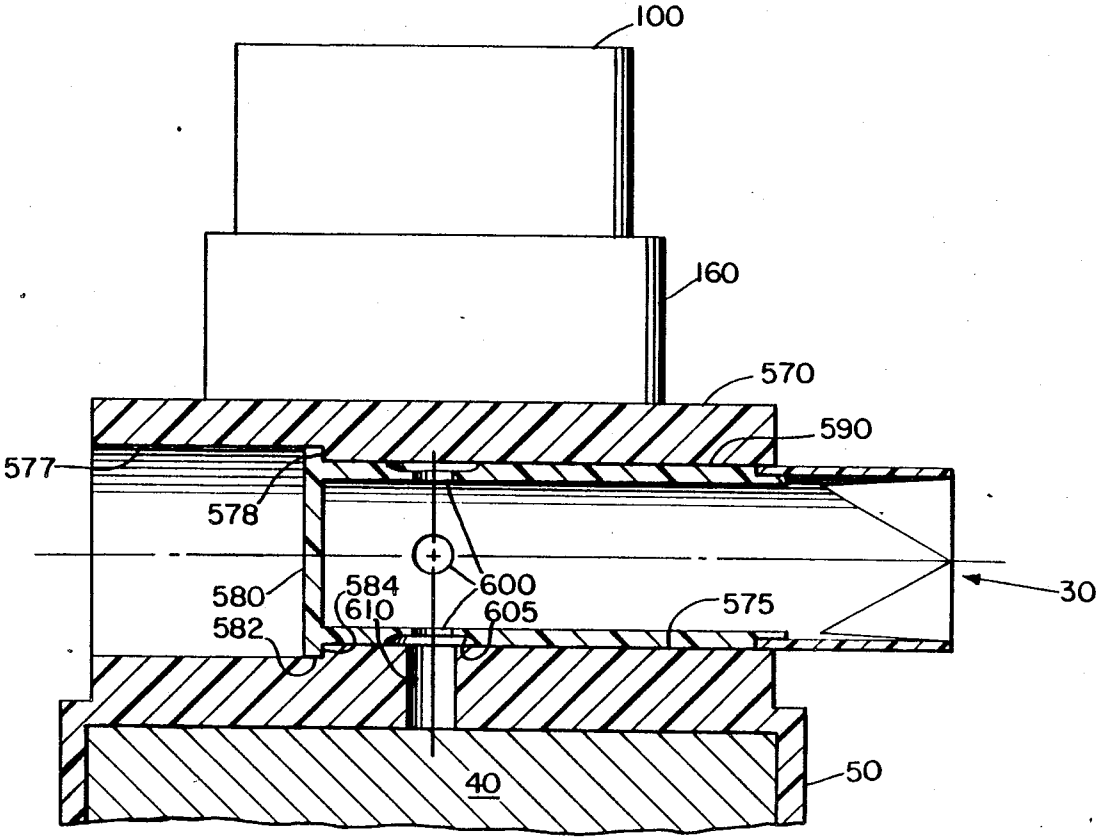
FIG. 13 is a greatly enlarged cross-sectional representation of the fluid conduit portion of the dispenser generally shown in FIG. 12, said view being taken along section line 13—13 of FIG. 12.

To permit dispensing of fluent material 40 from the package 510, the fluid conduit 590 must be extended, as generally shown in FIGS. 12 and 13. This can be accomplished by applying force directly to end wall 580 of fluid conduit 590 either directly by means of the user's finger or indirectly using an object small enough to be inserted in cylindrical bore 577. This seats innermost surface 584 of end wall 580 against shoulder 578 which joins cylindrical bore 577 to cylindrical bore 575. This also places peripheral groove 605 in alignment with orifice 610 in cylindrical bore 575. When pushbutton 100 is manually depressed with fluid conduit 590 in the "open" position illustrated in FIGS. 12 and 13, fluent material 40 passes through orifice 610, flows about peripheral groove 605 and enters the inlet end of fluid conduit 590 through the multiplicity of apertures 600. From this point, dispensing of fluent material 40 through pressure responsive self-sealing valve 30 proceeds in a manner identical to the dispensing cycle described in conjunction with package embodiment 10 shown in FIGS. 1–9.

It is of course recognized that many alternative valve configurations may be used to provide a non-pressure responsive valve in a package embodiment of the type generally illustrated in FIGS. 10–13. For example, means may be provided to prevent rotation of cylindrical fluid conduit 590, and a single aperture positioned so as to align precisely with orifice 610 when the fluid conduit is in its "open" position may be provided in the fluid conduit wall. Alternatively, the fluid conduit may be provided with a non-cylindrical cross-section to prevent rotation and thereby ensure continued alignment between an aperture in the fluid conduit wall and orifice 610 in cylindrical bore 575. The precise means chosen to provide a non-pressure responsive valve at the inlet to the fluid conduit is noncritical to the practice of the present invention.

FIGS. 14–17 disclose still another embodiment of a storage and dispensing package 710 of the present invention. The storage and dispensing package 710 employs many of the same elements illustrated in conjunction with the embodiments shown in FIGS. 1–9 and FIGS. 10–13. In particular, container body 50, follower piston 70, pushbutton 100 and its associated pumping mechanism, cylindrical container portion 160 and pressure responsive self-sealing valve 30 are all identical to the units utilized in the embodiments disclosed earlier herein.

However, package embodiment 710 employs a deformable diaphragm 770 which is secured about its perimeter to the uppermost portion of container body 50, to cylindrical container portion 160 and to the arcuate portion 793 of fluid conduit 790. This is best illustratd in the cross-sections of FIGS. 15 and 15A. The fluid conduit 790 has a pressure responsive self-sealing valve 30 of the type described earlier herein secured to its discharge end. It rotates about a hinge 725 which is formed at the point of joinder between the uppermost edge 792 of fluid conduit 790 and substantially planar surface 162 which is integrally formed with cylindrical portion 160 of container body 50. Substantially planar surface 162 is best shown in the cross-sections of FIGS. 17 and 17A.

The non-pressure responsive valve formed at the inlet end of fluid conduit 790 comprises planar surface 162 and the innermost end of fluid conduit 790. The valve is in its "off" position when fluid conduit 790 is in the position generally shown in FIGS. 16, 17 and 17A. It is generally taught that a leak resistant seal can be formed utilizing this technique in U.S. Pat. No. 4,440,327 issued to Dark on April 3, 1984 and hereby incorporated herein by reference. However, a common difficulty encountered with structures employing a valve of the type disclosed by Dark is that movement of the fluid conduit to its "closed" position after the package has been placed in service reduces the effective volume of the package. Accordingly, moving the valve to its "closed" position will displace a correponding amount of fluent material from the package as the diaphragm to which the fluid conduit is secured undergoes inversion. Although the amount of fluent material discharged in response to the closing action of the valve may not be highly significant from the standpoint of waste, it is nonetheless messy and results in fluent material being discharged onto the exterior surface of the fluid conduit and the container body.

The embodiment of Applicant's invention disclosed in FIGS. 14–17 not only provides bimodal dispensing, as described earlier herein, but in addition overcomes the aforementioned messiness problem. This is accomplished by providing a resiliently deformable diaphragm 770 which is deformed at a fluent material pressure which is less than that required to open the pressure responsive self-sealing valve 30. In the "open" position illustrated in FIGS. 14 and 15, resiliently deformable diaphragm 770 is in a relatively stretched and taut condition. Any downward movement of pushbutton 100 will cause fluent material 40 to enter the inlet end of fluid conduit 790 and thereafter pass through pressure responsive self-sealing valve 30 secured to the discharge end of the fluid conduit. Thus, when fluid conduit 790 is in its "open" position, operation of storage and dispensing package 710 is substantially identical to that of dispensers 10 and 510 shown in FIGS. 1–9 and 10–13, respectively.

Figure 16:
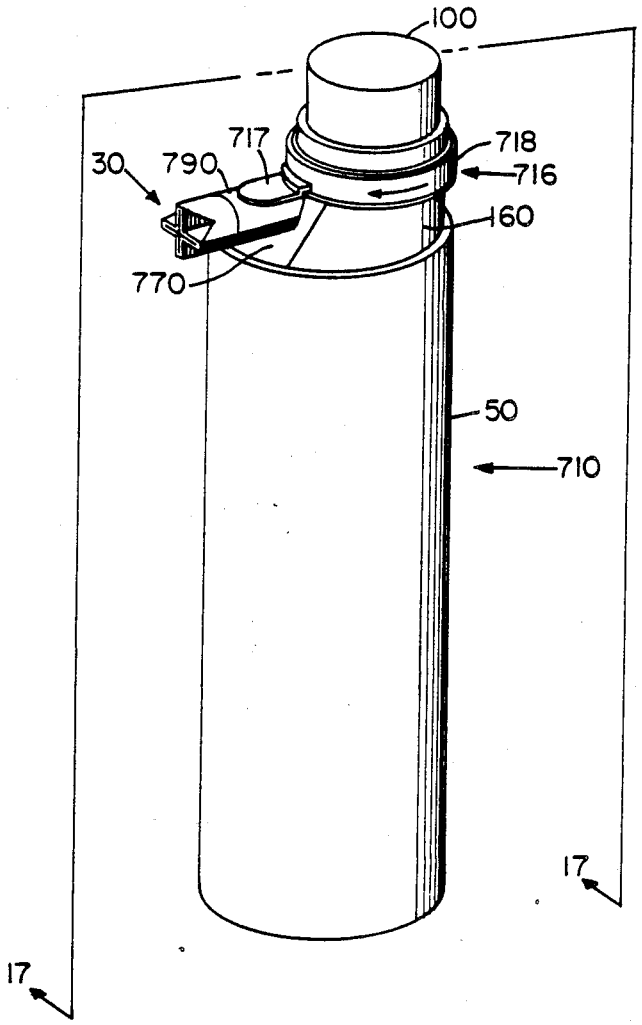
FIG. 16 is a simplified perspective representation of the storage and dispensing package shown in FIG. 14 with the fluid conduit shown in its "closed" position.
Figure 17:
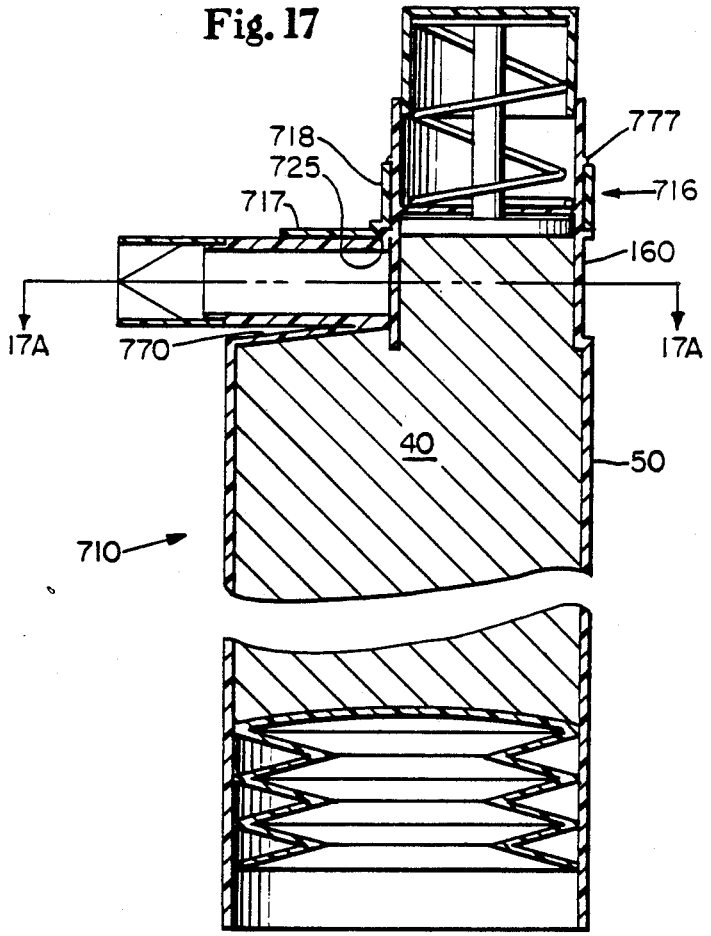
FIG. 17 is a simplified cross-sectional illustration of the storage and dispensing package shown generally in FIG. 16, said view being taken along section line 17—17 of FIG. 16.
Figure 17A:
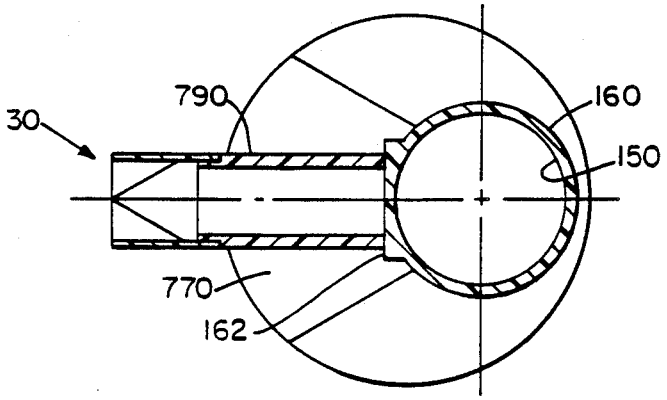
FIG. 17A is a cross-sectional illustration of the fluid conduit and the uppermost end of the container body, said view being taken along section line 17A—17A of FIG. 17.

However, when the innermost end of fluid conduit 790 and planer surface 162 are rotated about hinge 725 to the "closed" position of fluid conduit 790, as generally shown in FIGS. 16, 17 and 17A, the resiliently deformable diaphragm 770 is outwardly deformed to accommodate the resulting decrease in package volume. This diaphragm distention is best illustrated in FIGS. 16 and 17.

To avoid expelling fluent material through pressure responsive self-sealing valve 30 during closing of the non-pressure responsive valve located at the innermost end of fluid conduid 790, deformation of resiliently deformable diaphragm 770 must occur. To ensure that this happens, it is necessary that pressure responsive self-sealing valve 30 be designed so as to require an opening pressure which is greater than the pressure required to deform diaphragm 770 as the valve is closed. If the pressure required to open self-sealing valve 30 is lower than the pressure required to deform diaphragm 770 an amount sufficient to compensate for the resultant decrease in package volume, then fluent material 40 will be extruded through self-sealing valve 30 as the fluid conduit 790 rotates from its "open" to its "closed" position.

Figure 15:
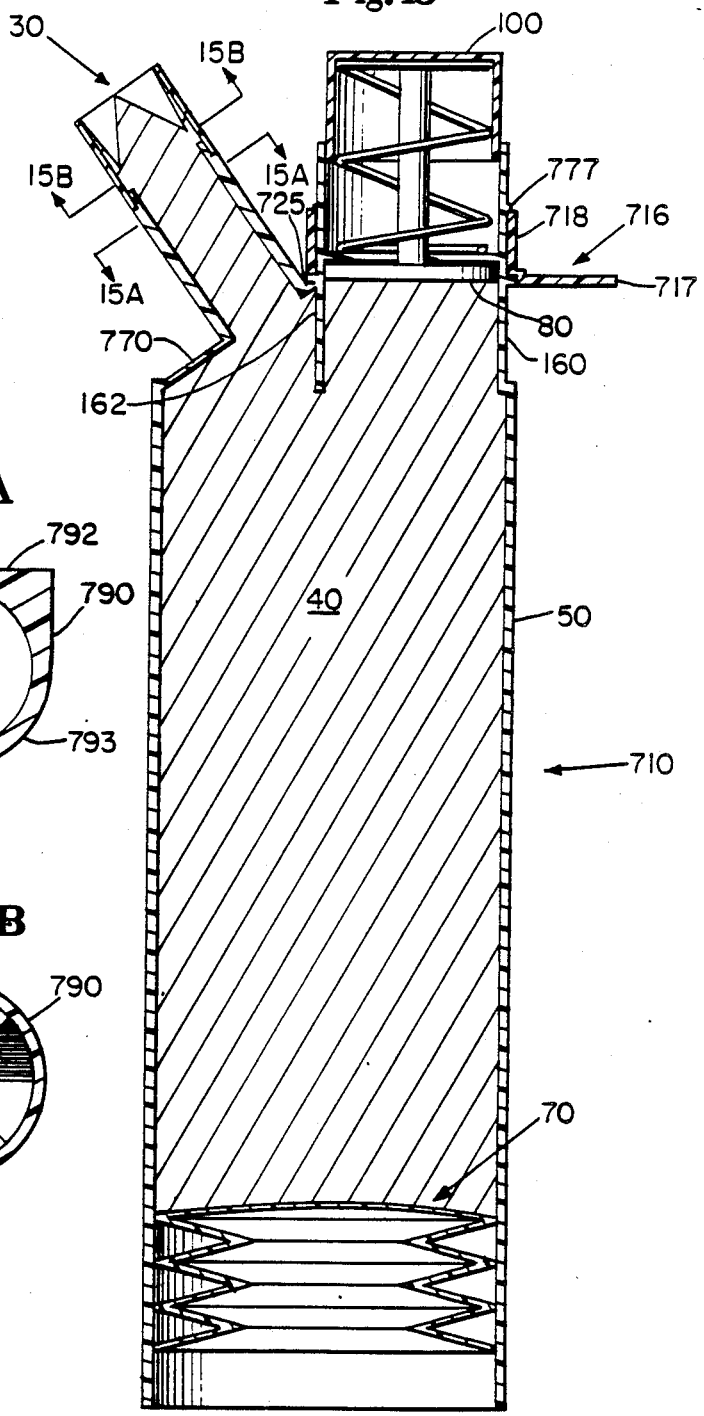
FIG. 15 is a cross-sectional illustration of the storage and dispensing package shown generally in FIG. 14, said view being taken along section line 15—15 of FIG. 14.
Figure 15A:
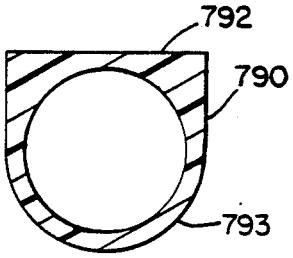
FIG. 15A is a cross-sectional illustration of the inlet end of the fluid conduit, said view being taken along section line 15A—15A of FIG. 15.
Figure 15B:
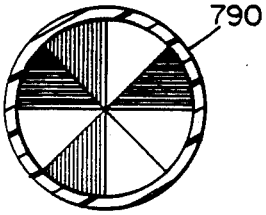
FIG. 15B is a cross-sectional illustration of the discharge end of the fluid conduit, said view being taken along section line 15B—15B of FIG. 15.

To ensure that the non-pressure responsive valve formed by the inlet end of fluid conduit 790 and planar surface 162 remains in its "closed" position, storage and dispensing package 710 employs a retaining mechanism 716 which is rotatably secured to the outermost surface of cylindrical portion 160 of container body 50, as generally shown in FIGS. 15, 16 and 17. Restraining mechanism 716 can comprise an annular ring 718 having a male projection 717 extending from at least one point about its periphery. The annular ring 718 is preferably rotatably secured about cylindrical portion 160 of container body 50 by means of a peripherally extending boss 777 which prevents ring 718 from moving upwardly once it has initially been installed. Installation of ring 718 can normally be accomplished by temporarily deforming ring 718, boss 777 or both until the ring slips past boss 777.

Figure 14:
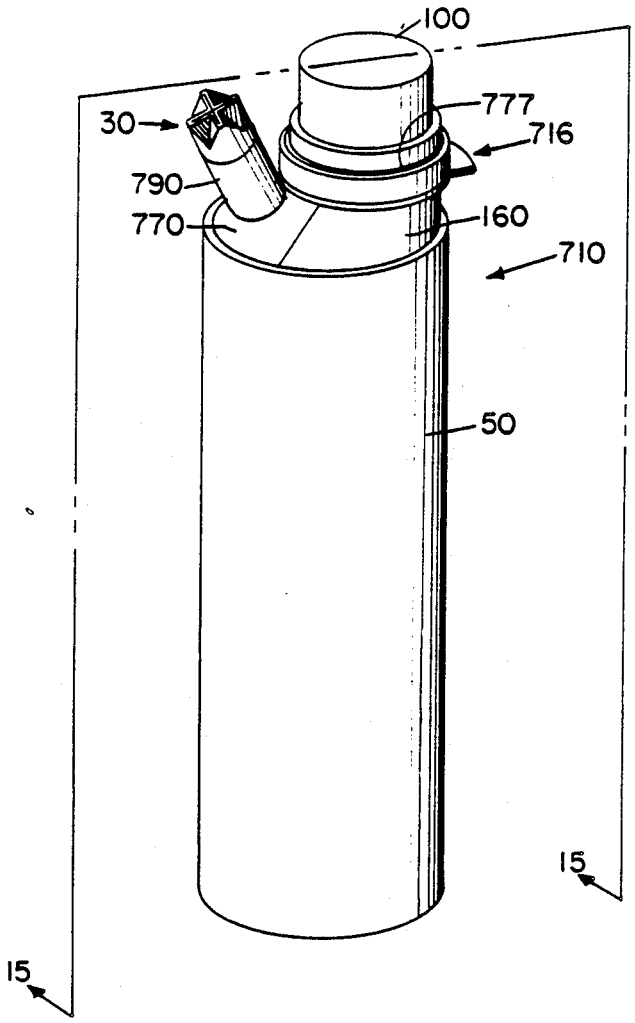
FIG. 14 is a simplified perspective representation of yet another embodiment of a storage and dispensing package of the present invention with its fluid conduit shown in the "open" position.

When it is desired to place the inlet of the fluid conduit 790 in communication with the fluent material 40 in container body 50, the restraining mechanism 716 is preferably rotated from the "closed" position shown in FIGS. 16 and 17 to the "open" position shown in FIGS. 14 and 15. This eliminates interference between male projection 717 on mechanism 716 and uppermost planar surface 792 of fluid conduit 790 adjacent hinge point 725. Elimination of this interference allows fluid conduit 790 to be rotated upwardly to its "open" position.

A particular advantage of a storage and dispensing package 710 of the type generally shown in FIGS. 14–17 is that no moving seals are required to open or close the non-pressure responsive valve formed between the inlet end of fluid conduit 790 and planar surface 162. Accordingly, no leakage can occur at these particular points. In addition, mechanisms of the aforementioned type may be integrally molded, as generally disclosed in the aforementioned U.S. Pat. No. 4,440,327 issued to Dark on April 3, 1984 and incorporated herein by reference. This, in turn, can result in economies of manufacture due to the elimination of assembly operations for multiple parts.

Figure 18:
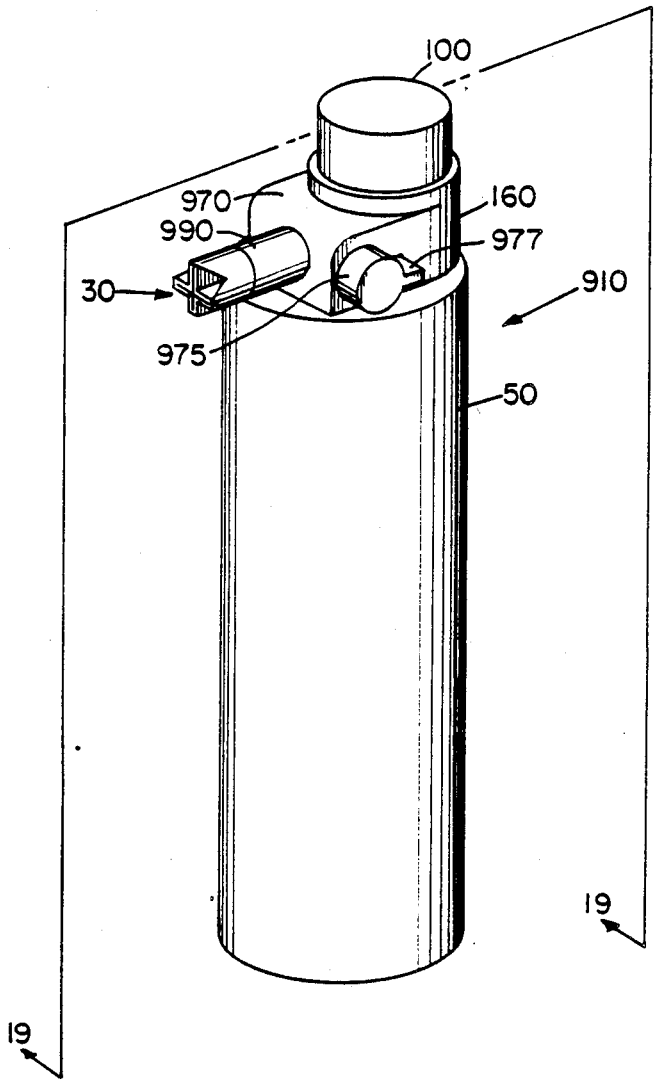
FIG. 18 is a simplified perspective representation of still another embodiment of a storage and dispensing package of the present invention, said storage and dispensing package being shown with its non-pressure responsive valve in the "closed" position.
Figure 19:
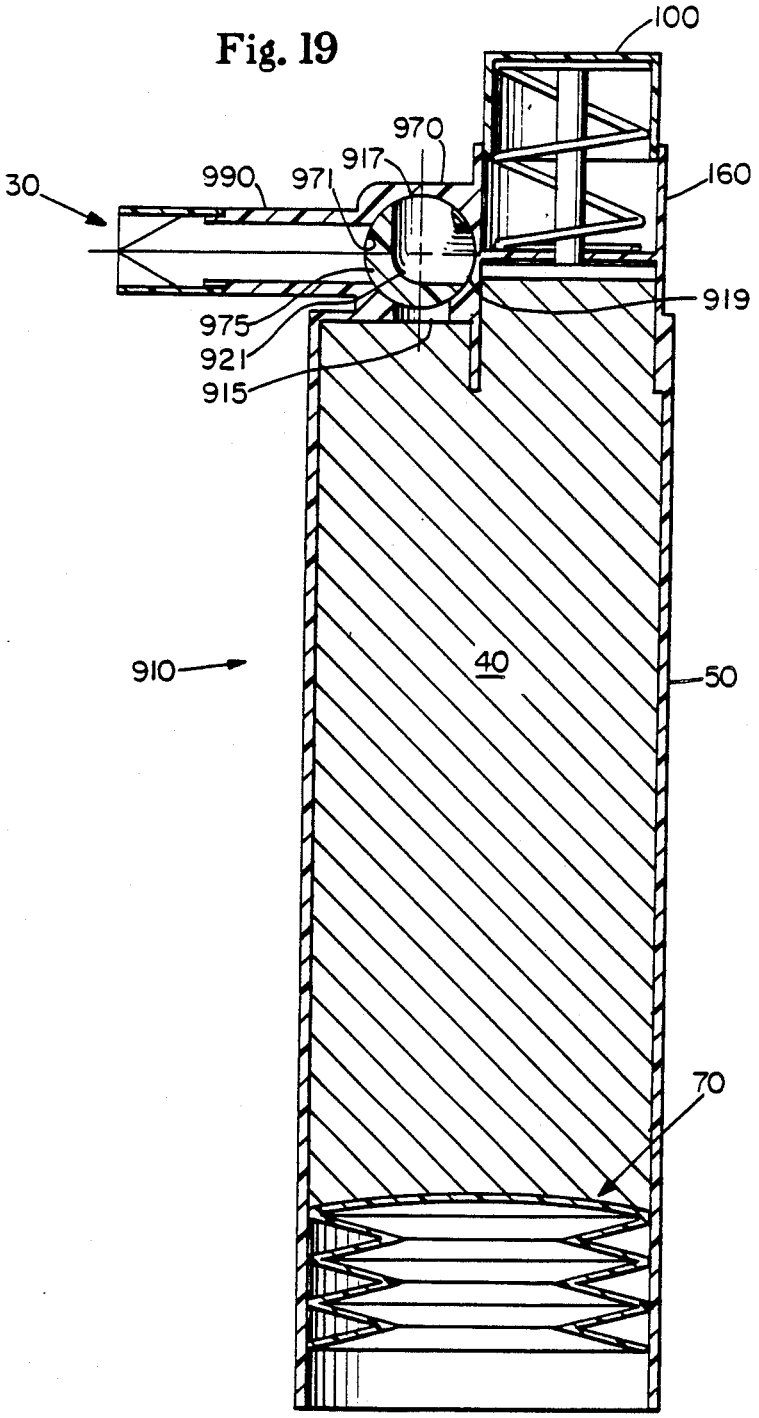
FIG. 19 is a simplified cross-sectional illustration of the storage and dispensing package shown in FIG. 18 taken along section line 19—19 of FIG. 18.
Figure 20:
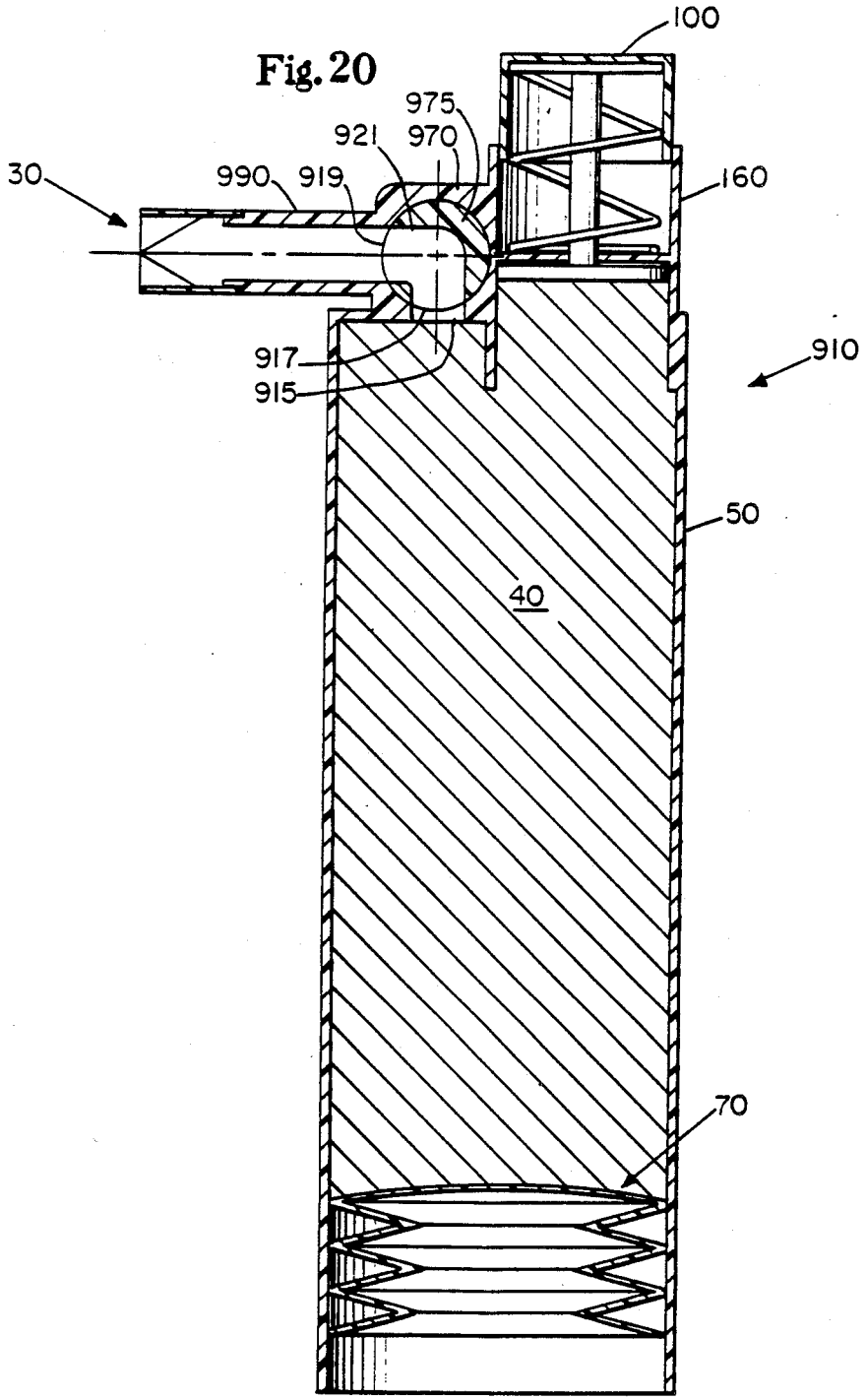
FIG. 20 is a cross-sectional illustration generally similar to that of FIG. 19 after the non-pressure responsive valve located at the inlet end of the fluid conduit has been switched to its "open" position.

FIGS. 18–20 disclose still another embodiment of a storage and dispensing package 910 of the present invention. Storage and dispensing package 910 employs of the same elements utilized in conjunction with the embodiments disclosed earlier herein. In particular, container body 50, one-way follower piston 70, push-button 100 and its related pumping mechanism and uppermost cylindrical portion 160 of the container body are identical. Pressure responsive self-sealing valve 30 is also identical to the self-sealing valve 30 utilized on the embodiments disclosed earlier herein.

In the package embodiment 910 shown in FIG. 18, fluid conduit 990 is "fixed" with respect to the uppermost portion of container body 50. As can thus be seen in the cross-sectional of FIG. 19, fluid conduit 990 is integrally molded into valve housing 970, which includes a cylindrical passageway 971 intended to accommodate rotary valve 975. Rotary valve 975 includes a passageway 921 which interconnects a pair of apertures 917, 919 which are separated approximately 90° from one another, as generally shown in FIG. 19. Rotary valve 975 also includes a pointer/switching tab 977 which not only indicates the position of rotary valve 975, but which is utilized to switch the valve from its "closed" position, as generally illustrated in FIGS. 18 and 19, to its "open" position, as generally illustrated in the cross-section of FIG. 20. This is accomplished by merely rotating tab 977 180° in the direction of self-sealing valve 30. In the condition shown in FIG. 19, i.e. the "closed" position, passageway 921 and apertures 917 and 919 are blocked by the interior surface of passageway 971. Similarly, orifice 915 in the uppermost portion of container body 50 is blocked by the exterior surface of rotary valve 975. In the illustrated position and increase in pressure of the fluent material 40 inside container body 50 will not permit passage of the fluent material 40 into the inlet end of fluid conduit 990.

However, once valve 975 has been rotated 180° to its "open" position, aperture 917 in rotary valve 975 aligns with orifice 915 in the uppermost portion of container body 50. In addition, aperture 919 in rotary valve 975 is aligned with the interior of fluid conduit 990. In this position, any increase in pressure of the fluent material 40 inside container body 50 will cause the fluent material to flow into fluid conduit 990 via passageway 921 and ultimately to be discharged through pressure responsive self-sealing valve 30 in a manner identical to that of the embodiments disclosed earlier herein.

Figure 21:
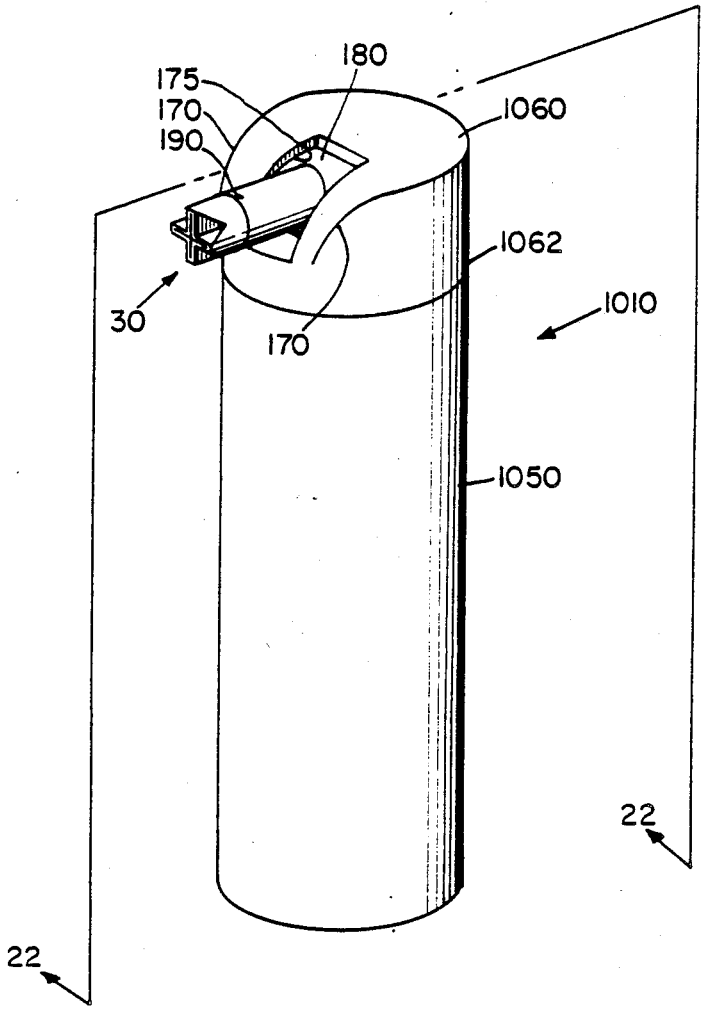
FIG. 21 is a simplified perspective representation of another embodiment of a storage and dispensing package of the present invention, said storage and dispensing package being shown with its non-pressure responsive valve in the "open" position.
Figure 22:
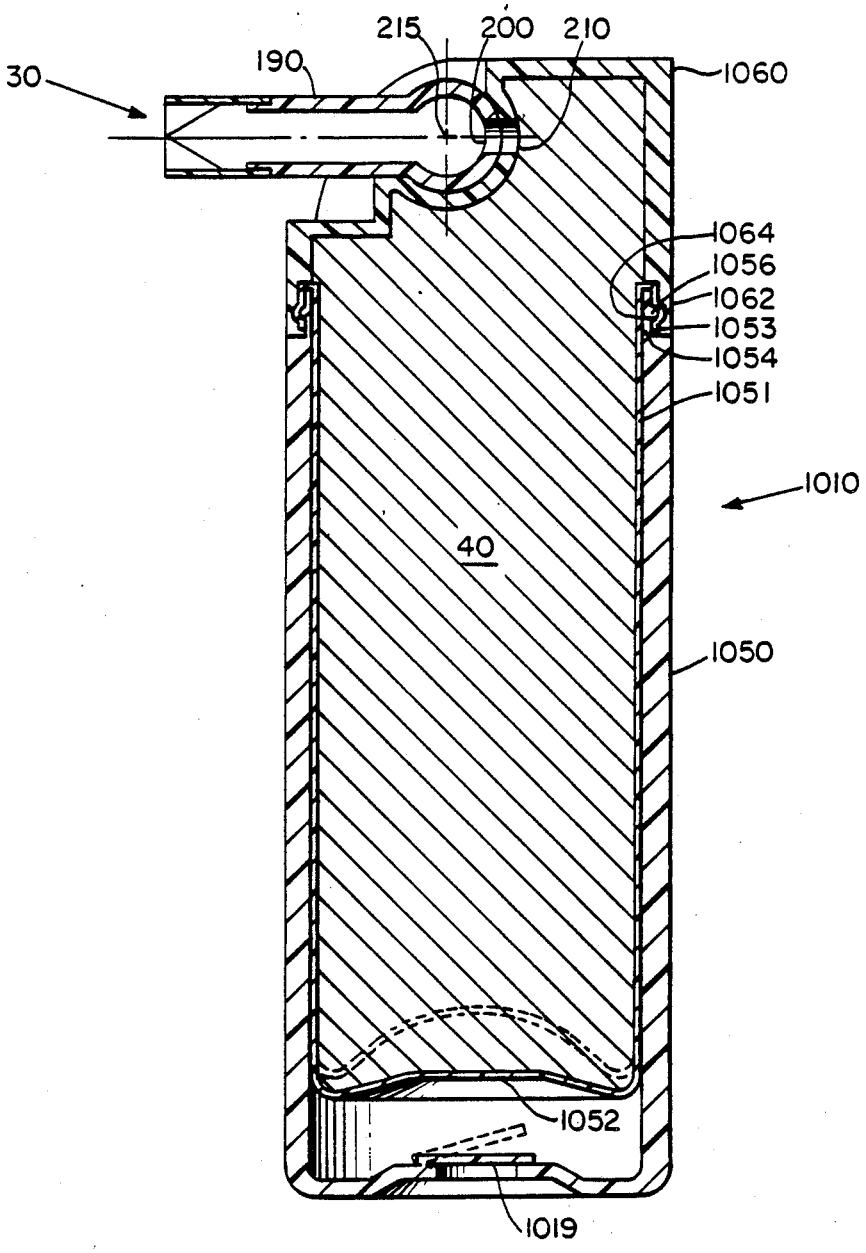
FIG. 22 is a simplified cross-sectional illustration of the storage and dispensing package shown in FIG. 21 taken along section line 22—22 of FIG. 21.

FIGS. 21 and 22 disclose still another embodiment of a storage and dispensing package 1010 of the present invention. Storage and dispensing package 1010 employs many of the same elements used in conjunction with the embodiments disclosed earlier herein. In particular, fluid conduit 190, self-sealing valve 30 and trunnions 170 including a pair of cylindrical openings 175 which accommodate cylindrical member 180 are substantially identical to those shown in embodiment 10 illustrated in FIGS. 1–9. As with the embodiment 10 of FIGS 1–9, fluid conduit 190 has an axis of rotation 215.

However, storage and dispensing package embodiment 1010, unlike the embodiments disclosed earlier herein, employs a resiliently deformable container body 1050 which includes a flaccid bag or pouch 1051, as generally shown in the cross-section of FIG. 22. The uppermost end of the bag 1053 is preferably applied over the uppermost end of the resiliently deformed container body 1050 by overlapping its perimeter over the uppermost end of the container body so that it covers the peripherally extending projection 1056 originating in surface 1054 of the container body. The bag 1051 is preferably filled with fluent material 40 and thereafter permanently secured in position by means of the overlapping portion 1062 of uppermost cylindrical member 1060. The innermost surface of portion 1062 includes a circumferentially extending groove 1064 having a shape complementary to that of the periphery extending projection 1056. Once the cylindrical member 1060 is snapped into position, the uppermost end of bag 1051 cannot escape.

The lowermost end of container body 1050 preferably includes check valve 1019 which prevents air from escaping from inside the resiliently deformable container body 1050 when the container body is squeezed to dispense product. However, the check valve, which may comprise a simple strip of rubber, is free to deflect to the dotted line position shown in the cross-section of FIG. 22 to permit air to enter the container when compressive forces on the container have been released. A similar result can, if desired, be accomplished by providing a simple hole in the wall of the container body, provided the user covers the hole each time the container is squeezed and uncovers the hole each time the container is released. In either case, repeated compression of the container body 1050 displaces the lowermost end 1052 of flaccid bag 1051 in the direction of the uppermost end of the package, as generally shown by the dotted lines in the cross-section of FIG. 22. This process will continue until substantially all of the fluent material 40 in the flaccid bag 1051 has been dispensed.

It will be appreciated that while the non-pressure responsive valve located at the inlet end of fluid conduit 190 is shown in its "open" position in FIGS. 21 and 22, it is feasible to orient orifice 200 in fluid conduit 190 and orifice 210 in cylindrical member 1060 relative to one onother so that the "open" position of the valve could be made to coincide with the longitudinally aligned position of fluid conduit 190, i.e., when the vertical centerline of the package 1010 and the centerline of the fluid conduit 190 are substantially parallel to one another. This would permit handling of the storage and dispensing package 1010 in a manner similar to a toothpaste tube, wherein the discharge orifice is located along the longitudinal axis of the tube.

It is further recognized that the fluid conduit 190 and the uppermost cylindrical portion 1060 of package 1010 could be so configured that the fluid conduit is aligned flush with the uppermost surface of cylindrical portion 1060 when the valve located at the inlet end of the fluid conduit is in its "closed" position (not shown). Depending upon how one chooses to position orifices 200 and 210 relative to one another, the "open" position of the non-pressure responsive valve can be made to occur when the axis of the fluid conduit 190 is oriented parallel to the vertical axis of the package or when the axis of the fluid conduit 190 is oriented perpendicular to the vertical axis of the package. If orifices 200 and 210 are positioned 180° apart, the non-pressure responsive valve could also be opened by rotating fluid conduit 180° from a nested horizontal position completely within cylindrical portion 1060 (not shown) to an outwardly extending position generally similar to that of FIGS. 21 and 22.

From the foregoing, it will be readily understood that various means for applying pressure to the fluent material in the container are known in the art, and the precise means chosen are not critical to the practice of the present invention.

While particular embodiments of the present invention have been illustrated and described, it will be obvious to those skilled in the art that various changes and modifications can be made without departing from the spirit and scope of the invention. For example, the manually operable pushbutton and associated pumping mechanism disclosed herein could be replaced with a resiliently deformable portion of the container body. Similarly, the one-way follower piston 70 could be replaced with a more conventional mechanically advanced piston with the addition of suitable linkage to advance the piston each time fluent material is discharged from the package. Still another possibility would involve replacement of the substantially rigid fluid conduit disclosed in the embodiments illustrated herein with a deformable fluid conduit with may be temporarily or permanently reoriented to substantially any desired discharge position upon manipulation by the user. It is intended to cover in the appended claims all such modifications that are with the scope of this invention.

What is claimed is:

1. A storage and dispensing package for fluent material, said package having a first mode of operation capable of storing said fluent material without leakage when said package is subjected to unintentional external forces and a second mode of operation capable of dispensing said fluent material when said package is subjected to external forces intentionally applied by the user, said second mode of operation also being capable of automatically isolating substantially all of the fluent material remaining in said package from the surrounding atmosphere as soon as said intentionally applied external forces are removed, said package comprising:

(a) a container for housing said fluent material;

(b) means for applying pressure to said fluent material in said container by applying external forces to said package;

(c) a conduit for transportation said fluent material from the interior of said container to the exterior of said container, said fluid conduit having an inlet end for receiving said fluent material from said container and a discharge end remote from said inlet end, said fluid conduit comprising a hollow tubular member having a closed end wall at its inlet end and a continuous side wall, said tubular member being slidable withing a complementary shaped sheath portion of said container;

(d) a first valve which does not open in response to pressure of the fluent material in said container, said first valve being located at said inlet end of said fluid conduit, said first valve having a closed position which correspond to said first mode of operation and which prevents fluid communication between said fluent material in said container and the inlet end of siad fluid conduit regardless of the pressure applied to said fluent material, said first valve also having and open position which corresponds to said second mode of operation and which permits fluid communication between the fluent material in said container and the inlet end of said fluid conduit, said first valve comprising a first orifice in said continuous side wall of said fluid conduit which is placed in fluid communications with a second orifice in said sheath portion of said container only when said first valve is in said open position, said first valve further including means for manually switching said valve between said closed position and said open position, said means for manually switching said first valve comprising said fluid conduit; and (e) a second valve located at the discharge end of said fluid conduit, said second valve being normally closed to prevent fluid communication between fluent material contained in said fluid conduit and the surrounding atmosphere, said second valve being openable only in response to pressure applied by said fluent material in said fluid conduit, said second valve being automatically closable whenever the pressure of said fluent material in said fluid conduit is relieved;

whereby leak résistant handling, shipping and storage of said fluent material contained in said package can be carried out while said first valve is in said closed position and dispensing of said fluent material from said package can be carried out while said first valve is in said open position by applying external forces to said container to pressurize said fluent material in said container and said fluid conduit.

2. A storage and dispensing package for fluent material, said package having a first mode operation capable of storing said fluent material without leakage when said package is subjected to unintentional external forces and a second mode of operation capable of dispensing said fluent material when said package is subjected to external forces intentionally applied by the user, said second mode of operation also being capable of automatically isolating substantially all of the fluent material remaining in said package from the surrounding atmosphere as soon as said intentionally applied external forces are removed, said package comprising:

(a) a container for housing said fluent material;

(b) means for applying pressure to said fluent material in said container by applying external forces to said package;

(c) a fluid conduit for transporting said fluent material from the interior of said container to the exterior of said container, said fluid conduit having an inlet end for receiving said fluent material from said container and a discharge end remote from said inlet end, said fluid conduit comprising a hollow tubular member having a closed end wall at its inlet end and a continuous side wall, said tubular member being slidable within a complementary shaped sheath portion of said container;

(d) a first valve which does not open in response to pressure of the fluent material in said container, said first valve being located at said inlet end of said fluid conduit, said first valve having a closed position which corresponds to said first mode of operation and which prevents fluid communication between said fluent material in said container and the inlet end of said fluid conduit regardless of the pressure applied to said fluent material, said first valve also having an open position which correponds to said second mode of operation and which permits fluid communication between the fluent material in said container and the inlet end of said fluid conduit, said first valve comprising a first orifice in said continous side wall which is placed in fluid communication with a second orifice in said sheath portion of said container only when first valve is in said open position, said fluid conduit being located completely within the transverse cross-sectional confines of said container, as viewed along the vertical axis of said container, when said first valve is in said closed position, the discharge end of said fluid conduit and said second valve being outside said transverse cross-sectional confines when said first valve is in said open position, said first valve further including means for manually switching said valve between said closed position and said open position, said means for manually switching said first valve comprising said fluid conduit; and (e) a second valve located at the discharge end of said fluid conduit, said second valve being normally closed to prevent fluid communication between fluent material contained in said fluid conduit and the surrounding atmosphere, said second valve being openable only in response to pressure applied by said fluent material in said fluid conduit, said second valve being automatically closable whenever the pressure of said fluent material in said fluid conduit is relieved;

whereby leak resistant handling, shipping and storage of said fluent material contained in said package can be carried out while said first valve is in said closed position and dispensing of said fluent material from said package can be carried out while said first valve is in said open position by applying external forces to said container to pressurize said fluent material in said container and said fluid conduit.

* * * * *

UNITED STATES PATENT AND TRADEMARK OFFICE

CERTIFICATE OF CORRECTION

PATENT NO. : 4,938,393

DATED : July 3, 1990

INVENTOR(S) : K. R. Ericson, P. K. Platt, R. H. Van Coney, Elmer K. Linman

It is certified that error appears in the above-identified patent and that said Letters Patent is hereby corrected as shown below:

ON TITLE PAGE :

1) In the REFERENCES CITED section, "1,362,333" should read -- 3,162,333 -- .

2) In the ABSTRACT, line 29, "communicaton" should read -- communication -- .

3) Column 2, line 7, "turrent" should read -- turret -- .

4) Column 3, line 20, "particular" should read -- particularly -- .

5) Column 11, line 46, "The" should read -- This -- .

6) Column 11, line 65, "desired" should read -- desirable -- .

7) Column 12, line 47, "boby" should read -- body -- .

8) Column 13, line 17, "an" should read -- and -- .

9) Column 13, line 54, "change" should read -- chance -- .

10) Column 13, line 64, "Hoewver" should read -- However -- .

11) Column 15, line 47, "correponding" should read -- corresponding -- .

12) Column 15, line 56, "Applicant's" should read -- Applicants' -- .

13) Column 16, line 18, "conduid" should read -- conduit -- .

14) Column 17, line 5, after "employs" insert -- many -- .

15) Column 17, line 17, "cross-sectional" should read -- cross-section -- .

16) Column 17, line 36, "and" should read -- an -- .

17) Column 17, line 68, "deformed" should read -- deformable -- .

18) Column 18, line 10, "periphery" should read -- peripherally -- .

19) Column 18, line 15, after "includes" insert -- a -- .

20) Column 18, line 39, "onother" should read -- another -- .

21) Column 19, line 19, "with", second occurrence, should read -- which -- .

22) Column 19, line 23, "with" should read -- within -- .

UNITED STATES PATENT AND TRADEMARK OFFICE

CERTIFICATE OF CORRECTION

PATENT NO. : 4,938,393

DATED : July 3, 1990

INVENTOR(S) : K. R. Ericson, P. K. Platt, R. H. Van Coney, Elmer K. Linman

It is certified that error appears in the above-identified patent and that said Letters Patent is hereby corrected as shown below:

23) Claim 1, line 42, after "a" insert -- fluid -- .

24) Claim 1, line 42, "transportation" should read -- transporting -- .

25) Claim 1, line 50, "withing" should read -- within -- .

26) Claim 1, line 56, "correspond" should read -- corresponds -- .

27) Claim 1, line 59, "siad" should read -- said -- .

28) Claim 1, line 61, "and" should read -- an -- .

29) Claim 1, line 67, "communications" should read -- communication -- .

30) Claim 2, line 26, after "mode" insert -- of -- .

31) Claim 2, line 50, "portion of" should read -- in -- .

32) Claim 2, line 65, "continous" should read -- continuous -- .

33) Claim 2, line 67, after "when" insert -- said -- .

Signed and Sealed this

Nineteenth Day of November, 1991

*Attest:*

HARRY F. MANBECK, JR.

*Attesting Officer* *Commissioner of Patents and Trademarks*